US010794351B2

(12) United States Patent
Densborn et al.

(10) Patent No.: US 10,794,351 B2
(45) Date of Patent: Oct. 6, 2020

(54) STARTER DEVICE FOR AN INTERNAL COMBUSTION ENGINE AND BACKPACK POWER TOOL WITH AN INTERNAL COMBUSTION ENGINE AND WITH A STARTER DEVICE FOR THE INTERNAL COMBUSTION ENGINE

(71) Applicant: Andreas Stihl AG & Co. KG, Waiblingen (DE)

(72) Inventors: Gerd Densborn, Waiblingen (DE); Harald Schliemann, Waiblingen (DE)

(73) Assignee: Andreas Stihl AG & Co. KG, Wailbingen (DE)

( * ) Notice: Subject to any disclaimer, the term of this patent is extended or adjusted under 35 U.S.C. 154(b) by 0 days.

(21) Appl. No.: 16/558,115

(22) Filed: Sep. 1, 2019

(65) Prior Publication Data

US 2019/0383255 A1 Dec. 19, 2019

Related U.S. Application Data

(63) Continuation-in-part of application No. 15/667,639, filed on Aug. 3, 2017, now Pat. No. 10,451,017.

(30) Foreign Application Priority Data

Aug. 10, 2016 (DE) ..... 10 2016 009 755

(51) Int. Cl.
*F02N 3/02* (2006.01)

(52) U.S. Cl.
CPC ..... *F02N 3/02* (2013.01)

(58) Field of Classification Search
CPC . F02N 3/02; F02N 15/006; F02N 5/02; A01D 34/6818; A01D 1/00; Y10T 74/155; F02B 63/02
See application file for complete search history.

(56) References Cited

U.S. PATENT DOCUMENTS

| | | | |
|---|---|---|---|
| 2,547,010 | A | 7/1946 | Jackson |
| 3,361,124 | A | 1/1968 | Fend |
| 4,457,726 | A | 7/1984 | Jacobsen |
| 4,662,158 | A | 5/1987 | Zerrer |
| 4,841,929 | A | 6/1989 | Tuggle et al. |

(Continued)

FOREIGN PATENT DOCUMENTS

| | | |
|---|---|---|
| CN | 204 209 226 | 3/2015 |
| CN | 204 392 934 | 6/2015 |

(Continued)

*Primary Examiner* — Carl C Staubach
(74) *Attorney, Agent, or Firm* — Gudrun E. Huckett

(57) ABSTRACT

A starter device for an internal combustion engine has a rope pulley and a starter rope wound onto the rope pulley. A rope guide guiding the starter rope from the guide pulley to a rope outlet opening of the starter device is provided. A guide element positioned at the rope outlet opening holds the starter rope in the rope outlet opening. The rope guide has at least one deflection element that is arranged at the rope outlet opening. The deflection element has two tangents which are intersecting each other at an angle of less than 90°. The deflection element has a minimal radius of a length that is longer than a length of a diameter of the starter rope. The starter handle can be positioned relative to the rope outlet opening at different orientations and enables ergonomic starting of the internal combustion engine of a backpack power tool.

14 Claims, 17 Drawing Sheets

(56) References Cited

U.S. PATENT DOCUMENTS

| | | | |
|---|---|---|---|
| 6,244,233 | B1 | 6/2001 | Tryon et al. |
| 6,457,695 | B1 | 10/2002 | Tausanovitch |
| 7,806,107 | B2 | 10/2010 | Knauss et al. |
| 9,759,176 | B2 | 9/2017 | Mezaki et al. |
| 2003/0056746 | A1 | 3/2003 | Tezuka et al. |
| 2003/0140884 | A1 | 7/2003 | Matsubayashi et al. |
| 2003/0217723 | A1 | 11/2003 | Aiyama et al. |
| 2006/0180113 | A1 | 8/2006 | Pattullo |
| 2007/0251484 | A1 | 11/2007 | Pattullo |
| 2012/0118254 | A1 | 5/2012 | Leufen et al. |
| 2015/0047593 | A1 | 2/2015 | Geyer et al. |

FOREIGN PATENT DOCUMENTS

| | | |
|---|---|---|
| JP | S5769968 | 4/1982 |
| JP | 09-264089 | 10/1997 |
| JP | 11127670 | 10/1997 |
| JP | 2009-189303 | 8/2009 |

STARTER DEVICE FOR AN INTERNAL COMBUSTION ENGINE AND BACKPACK POWER TOOL WITH AN INTERNAL COMBUSTION ENGINE AND WITH A STARTER DEVICE FOR THE INTERNAL COMBUSTION ENGINE

CROSS-REFERENCE TO RELATED APPLICATIONS

This application is a continuation-in-part application of U.S. application Ser. No. 15/667,639 having a filing date of Aug. 3, 2017, said United States application claiming a priority date of Aug. 10, 2016 based on prior filed German patent application No. 10 2016 009 755.8, the entire contents of the aforesaid United States application and the aforesaid German patent application being incorporated herein by reference.

BACKGROUND OF THE INVENTION

The invention relates to a starter device for an internal combustion engine and a backpack power tool with an internal combustion engine and with a starter device.

JP 2009-189303 A discloses a backpack spraying device that is driven by an internal combustion engine. The internal combustion engine is to be started by means of a starter device that comprises a starter rope. From the internal combustion engine arranged on a backpack carrier, the starter rope is extending laterally and forwardly into the region of the back plate of the backpack carrier. The starter handle projects forwardly to one side of the operator. The starter rope is guided adjacent to the starter handle on a pivot bearing. By adjusting the pivot bearing, the orientation of the starter handle can be changed. The construction of the starter device is comparatively complex.

The invention has the object to provide a starter device for an internal combustion engine that has a simple configuration and enables comfortable starting of the internal combustion engine for different orientations of the starter handle. A further object of the invention resides in providing a backpack power tool with an internal combustion engine and with a starter device.

SUMMARY OF THE INVENTION

This object is solved with respect to the starter device in accordance with the invention by a starter device for an internal combustion engine, wherein the starter device comprises a starter rope on which a starter handle is secured, wherein the starter device comprises a rope guide for the starter rope that guides the starter rope from a rope pulley of the starter device to a rope outlet opening, wherein at the rope outlet opening a guide element is arranged that holds the starter rope in the rope outlet opening, wherein the rope guide comprises at least one deflection roller, wherein the rope outlet opening is arranged along a circumferential section of the deflection roller of the rope guide, and wherein the rope outlet opening extends along the circumferential section across a peripheral angle of the deflection roller of at least 60°.

With respect to the backpack power tool, the object is solved by a backpack power tool with an internal combustion engine and with a starter device, wherein the starter device comprises a starter rope on which a starter handle is secured, wherein the starter device comprises a rope guide for the starter rope that guides the starter rope from a rope pulley of the starter device to a rope outlet opening, wherein at the rope outlet opening a guide element is arranged that holds the starter rope in the rope outlet opening, wherein the rope guide comprises at least one deflection roller, wherein the rope outlet opening is arranged along a circumferential section of the deflection roller of the rope guide, and wherein the rope outlet opening extends along the circumferential section across a peripheral angle of the deflection roller of at least 60°.

At the rope outlet opening, a guide element is arranged that holds the starter rope in the rope outlet opening. The rope guide comprises at least one deflection roller and the rope outlet opening is arranged along a circumferential section of the deflection roller of the rope guide. The rope outlet opening extends along the circumferential section across a peripheral angle of the deflection roller of at least 60°. The peripheral angle amounts advantageously to more than 90°, expediently more than 100°, in particular more than 110°, and preferably more than 120°.

Since the rope outlet opening is arranged along a circumferential section of a deflection roller and extends about a peripheral angle of at least 60°, the orientation of the starter rope in the rope outlet opening can be changed by a simple movement of the starter handle in the corresponding direction. In this way, the longitudinal center axis of the starter handle can be positioned at different angles relative to a housing of the starter device. A complex rotary bearing for the starter rope is not needed. The deflection of the starter rope is achieved by the deflection roller and the appropriately arranged and sized rope outlet opening.

In this context, the extension of the rope outlet opening along the circumferential section is advantageously an extension that, in radial direction, is immediately located on the circumference of the deflection roller of the rope guide or an arrangement of the rope outlet opening in which the rope outlet opening, relative to the circumference of the deflection roller, has a radial spacing that amounts to at most twice the length of the diameter, preferably amounts at most to the length of the diameter, of the deflection roller.

Advantageously, the guide element delimits the rope outlet opening at least partially. The rope outlet opening extends advantageously across a width measured parallel to the axis of the deflection roller, wherein the width amounts to advantageously 1 times up to 3 times the width of the deflection roller. The width of the rope outlet opening is preferably smaller than the width of the bottom side of the starter handle facing the rope outlet opening so that the starter handle with its bottom side can be supported in axial direction on the guide element at both sides relative to the starter rope. The rope outlet opening extends advantageously along the circumference of the deflection roller across a length that is greater than the extension of the starter handle at the bottom side. In this way, the starter handle cannot be supported with its bottom side, or supported only with one end, on the guide element in circumferential direction. The length of the rope outlet opening is advantageously at least 3 times as large as the measured width of the rope outlet opening that is measured parallel to the axis of the deflection roller.

The rope outlet opening is comprised along its length preferably of at least two sections that are angularly positioned relative to each other. The angle which is measured at the location of the deflection roller in viewing direction of the axis of the deflection roller amounts advantageously to less than 120°, in particular less than 90°, preferably less than 70°, in particular amounts to approximately 60°.

The starter handle comprises advantageously a first start position in which the starter handle is arranged at the rope outlet opening in a first end position and a second start position in which the starter handle is arranged at the rope outlet opening in a second end position. In the first end position of the starter handle, the bottom side of the starter handle is advantageously arranged on a different one of the sections that are angularly positioned relative to each other than in the second end position.

Advantageously, the starter handle is resting on the guide element when the starter device is not actuated. The force which is required for the starter handle to contact the guide element and which is acting in the direction of the starter rope is preferably applied by a recoil spring of the starter device which pulls the starter handle against the guide element. In an advantageous configuration, the guide element is formed by a housing of the starter device. Advantageously, the starter handle is not secured with form fit on the guide element in a transverse direction of the circumferential section but is slidable relative to the guide element in the direction of an axis of the deflection element. In this way, the starter handle can yield laterally, for example, when an operator gets caught on the starter handle, so that the forces cannot be introduced into the rope guide. In this way, damage to the rope guide is prevented.

A simple configuration results when the guide element is at least partially formed by a wire ring. In this way, a simple and durable, wear-resistant configuration can be achieved. In this context, the wire ring must not have a circular shape and is in particular embodied as an open, preferably slotted, wire ring. The wire ring is secured advantageously in a housing of the starter device. Particularly preferred, the wire ring is clipped into a housing of the starter device. The housing of the starter device is comprised preferably of a plastic material in this context so that a minimal weight of the housing results.

In order to avoid that the starter rope can slide laterally off the deflection roller or can get jammed between guide element and deflection roller on the lateral face of the deflection roller, it is advantageously provided that a spacing between the guide element and the lateral face of the deflection roller which is measured parallel to the axis of the deflection roller is smaller than the length of the diameter of the starter rope. The spacing is in particular smaller than half the length of the diameter of the starter rope. The deflection roller can be secured fixedly (non-rotatably) on a starter housing of the starter device or can be embodied as one piece together with the starter device. In order to provide as little friction as possible between the starter rope and the deflection roller, the deflection roller is preferably supported rotatably about its axis. The rotary bearing for the deflection roller can be embodied in a simple way and requires only minimal constructive expenditure. At the same time, friction between starter rope and deflection roller can be significantly reduced. In this way, the starting forces required for starting the internal combustion engine can be reduced.

Advantageously, the rope guide comprises a second deflection roller across which the starter rope is guided, wherein the second deflection roller is contacting a rope section between the rope pulley and the first deflection roller. By arranging at least one second deflection roller, the starter rope can be guided reliably even across a greater distance between the rope pulley and the rope outlet opening. In this way, a suitable ergonomic position for the operator with respect to the rope outlet opening can be achieved in a simple way. Advantageously, the axis of the second deflection roller is arranged perpendicular to the axis of the first deflection roller. Therefore, the deflections about two spatial axes which are positioned perpendicularly to each other in space are realized by means of the two deflection rollers. In this way, a defined deflection and a good guiding action of the starter rope about the deflection rollers are enabled. Preferably, the rope guide comprises a third deflection roller which is contacting the starter rope at a rope section between the rope pulley and the second deflection roller. The third deflection roller is advantageously a deflection roller arranged adjacent to the rope pulley of the starter device. Between the second deflection roller and the third deflection roller, additional deflection rollers can be provided, as needed.

The rope guide is advantageously arranged at least partially in a projecting arm of a starter housing. The starter device is advantageously configured as a module. Accordingly, all components of the starter device, including the rope guide, are connected to each other in such a way that they form a modular assembly. In this way, the entire starter device can be mounted on a power tool or can be demounted from a power tool as a module. In this context, the position of the rope outlet opening is constructively predetermined in the module relative to the other components of the starter device. The position of the rope outlet opening is advantageously not adjustable relative to the other components of the starter device. The adjustment of the position of the starter handle at the rope outlet opening is realized by changing the position of the handle relative to the rope outlet opening but not by changing the position of the rope outlet opening relative to other components of the starter device.

A simple configuration is realized when the starter device comprises a starter housing on which all components of the starter device are secured. The starter housing must not be a closed housing in this context but can be partially open and can be configured in particular to be connectable to a housing of the power tool, for example, a motor housing of the power tool. The position of the rope outlet opening is advantageously constructively predetermined on the starter housing. In this way, the position of the rope outlet opening can be predetermined in a simple way relative to the other components of the starter device.

Advantageously, the starter device is configured such that the starter handle in non-actuated position is always arranged in the same position so that the operator intuitively can grip the starter handle in this position. The starter handle comprises advantageously a first start position in which the starter handle is arranged in a first end position at the rope outlet opening as well as a second start position in which the starter handle is arranged in a second end position at the rope outlet opening. When the starter device is in non-actuated state, the starter handle is advantageously arranged in the first start position as a result of the forces which are acting on the starter rope. The configuration of the rope outlet opening is therefore selected such that, in any position, forces are acting on the starter handle in a direction of the first end position.

The starter handle comprises advantageously a bottom side which is facing the rope outlet opening. The bottom side of the starter handle is advantageously configured for contacting the guide element. The starter handle comprises a center plane which contains the longitudinal center axis of the starter rope at the bottom side of the starter handle and which is extending parallel to the axis of the first deflection roller. The spatial position of the center plane relative to the guide element changes thus upon a change of the position of the starter handle relative to the rope outlet opening. In the second start position, the starter handle is advantageously resting on the guide element exclusively on the side of the center plane that is facing the axis of the deflection roller. Since the starter handle is not contacting the guide element on the side of the center plane which is facing away from the axis of the deflection roller, the starter handle can be moved in the direction toward the side of the center plane facing away from the axis due to the recoil force of a recoiling device of the starter device that is acting on the starter rope, and the starter handle can thus be moved into the first end position.

For an alternative configuration of a starter device, it is advantageously provided that at the rope outlet opening a guide element holding the starter rope in the rope outlet opening is arranged and that the rope guide comprises at least one deflection element that is arranged at the rope outlet opening. The deflection element comprises two tangents that are intersecting each other at an angle of less than 90°. The circumferential section comprises a minimal radius that is greater than a length of a diameter of the starter rope.

The two tangents each correspond advantageously to the longitudinal direction of the starter rope in the end positions of the starter handle at the rope guide. The angle between the two tangents is the complementary angle relative to the maximum deflection angle about which the starter rope is deflected by the deflection element. The angle between the two tangents and the maximum deflection angle therefore amounts to 180°. The angle between the two tangents is measured at the side which is facing away from the rope outlet opening. Between the two tangents, the defection element and one or a plurality of axes of the deflection element about which the deflection element is extending in a curved shape are located on the side where the angle between the tangents is measured. In any position in which the starter handle is resting against the guide element, the starter handle is located outside of the region between the tangents in which the angle between the tangents is measured.

Since the two tangents at the deflection element are positioned at an angle of less than 90° relative to each other, the orientation of the starter rope in the rope outlet opening can be changed by a simple movement of the starter handle in the corresponding direction about an angle of more than 90°. In this way, the longitudinal center axis of the starter handle can be positioned at different angles relative to a housing of the starter device. A complex rotary bearing for the starter rope is not needed. The deflection of the starter rope is achieved by the deflection element and the appropriately arranged and sized rope outlet opening. The configurations described for the starter device with a deflection roller can advantageously also be provided for a starter device with a deflection element.

The angle between the tangents amounts advantageously to less than 80°, in particular less than 70°, preferably less than 60°. In this way, a great variation in the orientation of the starter handle for the starting process is enabled. Due to the comparatively large minimal radius of the circumferential section of the deflection element, damage to the starter rope, as is to be feared for deflection across an edge of a rope outlet opening that is not rounded or rounded only minimally, can be avoided in a simple way. Preferably, the minimal radius of the deflection element amounts to at least 8 mm, in particular at least 13 mm. The deflection element adjoins the rope outlet opening advantageously immediately or with minimal spacing. The spacing between the deflection element and the rope outlet opening amounts advantageously to at most 4 times the length of the minimal radius, in particular at most twice the length of the minimal radius. In a particularly advantageous configuration, the deflection element projects through the rope outlet opening into the rope guide. In this way, a particularly minimal deflection radius can be achieved.

The deflection element comprises advantageously an axis about which the deflection element is curbed with the radius. In this context, preferably a constant radius is provided. When the radius is not constant, advantageously a plurality of axes are provided that are positioned at a spacing relative to each other and about which the deflection element extends in a curved shape.

Instead of the second deflection roller and the third deflection roller, it is also possible to provide deflection elements that are not configured as a roller and that are in particular fixedly secured (non-rotatably) on the starter housing.

For a backpack power tool with an internal combustion engine and with a starter device, it is provided that the internal combustion engine is arranged on a backpack carrying system. The power tool comprises a rest position in which the power tool is put down on a flat horizontal support surface. The starter handle comprises a first start position in which the starter rope in the rope outlet opening, in the rest position of the power tool, is slanted at an angle of less than 45° relative to the support surface, in particular less than 40°. Advantageously, the first start position is a position in which the handle axis and/or the starter rope in the rope outlet opening, in the rest position of the power tool, is slanted relative to the support surface at an angle of less than 45°, in particular by an angle of less than 40°. The starter rope and/or the starter handle axis are advantageously slanted such that the spacing of the starter rope toward the support surface in the direction toward the starter handle becomes smaller or that the starter handle at its bottom side has a greater spacing to the support surface than at the topside which is opposite the starter rope. The starter handle comprises also a second start position. In the second start position, the starter rope in the rope outlet opening, in the rest position of the power tool, is slanted relative to the vertical at an angle of less than 15°, in particular less than 10°. Advantageously, the second start position is a position in which the starter handle axis and/or at the starter rope in the rope outlet opening, in the rest position of the power tool, is slanted relative to the vertical at an angle of less than 15°, in particular less than 10°. The starter handle is therefore in an approximately horizontal orientation in the first start position, and the starter handle is in an approximately vertical orientation in the second start position.

The first start position is in particular beneficial for starting the internal combustion engine when the operator carries the power tool on the back. For starting the internal combustion engine in the first start position, the starter handle can be moved forwardly relative to the operator. The second start position is particularly beneficial when the operator wants to start the internal combustion engine when the power tool is standing on the ground. In the second start position, the operator can comfortably start the internal combustion engine in the rest position by pulling upwardly the starter handle. Also, pulling the starter handle at a slant to the rear can be advantageous. The configuration of the rope outlet opening enables thus an ergonomic starting action when the power tool is carried on the back by means of the backpack carrying system as well as when the power tool is placed on the ground. The position of the rope outlet opening relative to the backpack carrying system is advantageously unchangeable.

When the starter device is not actuated, the starter handle is advantageously arranged in the first start position. The starter device comprises advantageously a recoiling device that generates a force acting on the starter rope in the recoiling direction wherein the guide element is designed such that the force of the recoiling device in the second start position exerts a force component on the starter handle acting in the direction of the first start position. By means of the force that is applied by the recoiling device, in particular by a recoil spring, the starter handle can thus be adjusted safely into the first start position.

The starter device is held together with the rope guide advantageously on a common starter housing. The starter housing is embodied separate from a motor housing of the power tool in which the internal combustion engine is arranged. By arranging the starter device, including the rope guide, on a starter housing which is separate from the motor housing, the starter device can be mounted on the motor housing and demounted from the motor housing as a module, i.e., as a single assembly. In this way, mounting of the starter device is simplified.

Embodiments of the invention will be explained in the following with the aid of the drawings.

BRIEF DESCRIPTION OF THE DRAWINGS

FIG. 8 is a plan view of the starter device in the direction of arrow VIII of

FIG. 6.

DESCRIPTION OF PREFERRED EMBODIMENTS

Figure 1:
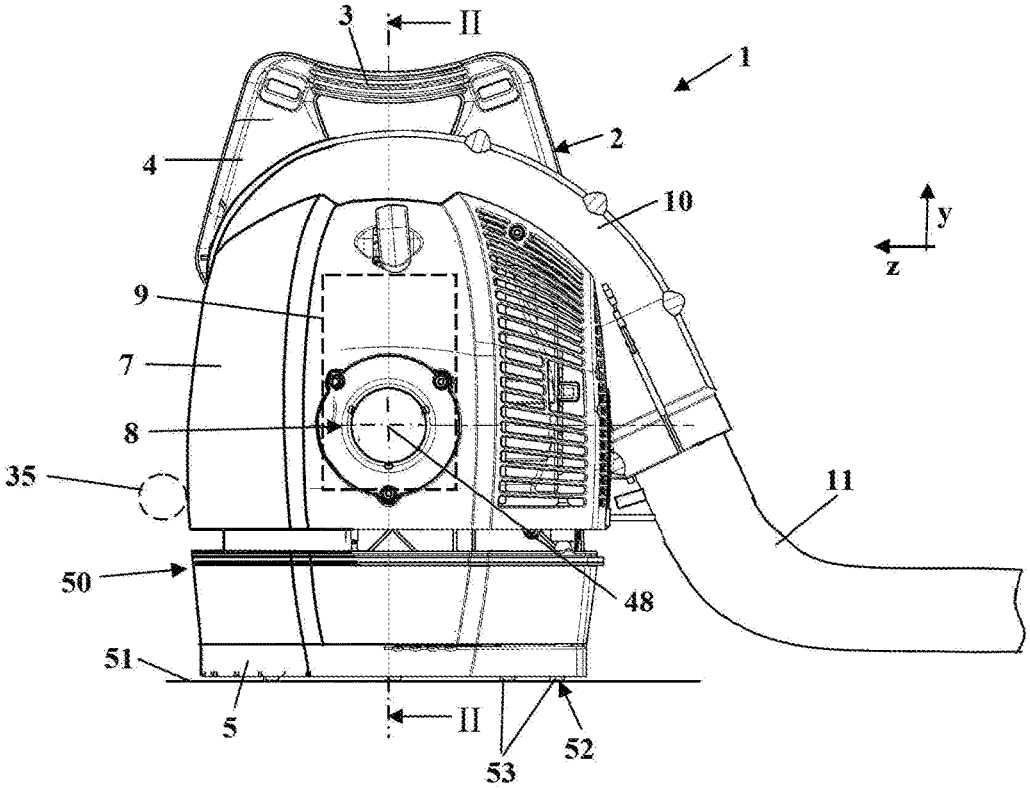
FIG. 1 is a schematic illustration of an embodiment of a backpack blower device.

FIG. 1 shows an embodiment of a backpack power tool in the form of a blower device 1. The backpack power tool can also be a different power tool driven by an internal combustion engine, for example, a spraying device, a vacuum device, a trimmer with a backpack motor unit or the like. The blower device 1 comprises a backpack carrier 2 comprising a back plate 4 as well as a bottom plate 5. FIG. 1 shows the blower device 1 in a rest position 50 in which the blower device 1 with the bottom plate 5 is arranged on a flat horizontal support surface 51. In the embodiment, on a bottom side 52 of the blower device 1 that is facing the support surface 51 and is formed on the bottom plate 5, a plurality of support legs 53 are provided with which the blower device 1 is standing on the support surface 51. In the rest position 50, a carrying handle 3 is provided in the upper region of the power tool, in particular on the back plate 4 or a blower spiral 10.

The blower device 1 comprises a motor housing 7 in which an internal combustion engine 9 is arranged. The internal combustion engine 9 is advantageously a single cylinder engine, in particular a two-stroke engine or a mixture-lubricated four-stroke engine. For starting the internal combustion engine 9, a starter device 8 is provided. The internal combustion engine 9 drives a blower wheel 12 illustrated in FIG. 2 that conveys a working air stream through the blower spiral 10 into a blower tube 11 connected to the blower spiral 10. On the blower tube 11, a handle is usually secured, not illustrated in FIG. 1, with which the operator can guide the blower tube 11. The starter device 8 comprises a starter handle 35 whose position is schematically illustrated in FIG. 1. The starter handle 35 in the embodiment is arranged laterally adjacent to the back plate 4, preferably in a lower region of the back plate 4.

Figure 2:
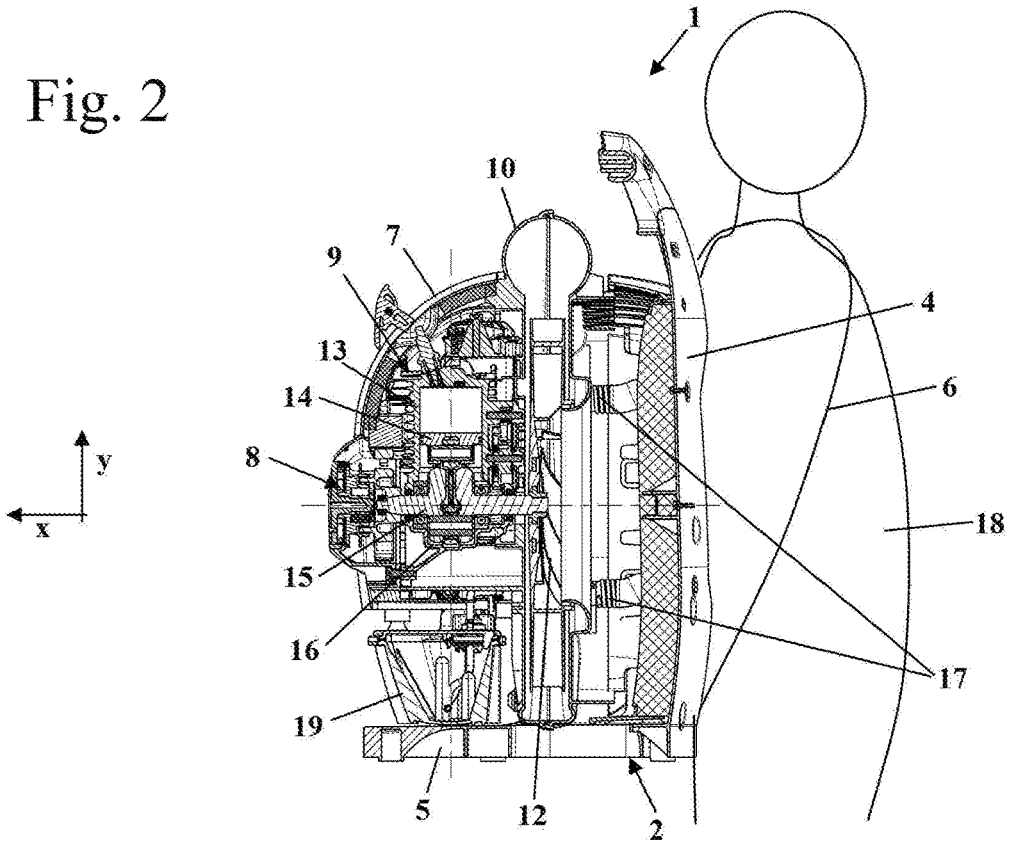
FIG. 2 is a schematic section illustration along the section line II-II of FIG. 1.

FIG. 2 shows schematically the blower device 1 carried by an operator 18. The operator 18 carries the blower device 1 by means of carrying straps 6 secured on the backpack carrier 2. The motor housing 7 is advantageously secured by means of antivibration elements 17 on the backpack carrier 2 so as to be vibration decoupled. In the embodiment, the blower spiral 10 is arranged adjacent to the back plate 4 and the internal combustion engine 9 is arranged on the side of the blower spiral 10 which is facing away from the back plate 4. The internal combustion engine 9 comprises a cylinder 13 in which a piston 14 is supported reciprocatingly. The piston 14 drives a crankshaft 15 which is rotatably supported in a crankcase 16. The blower wheel 12 is fixedly secured to the crankshaft 15 and is driven in rotation by the crankshaft 15. In the embodiment, a fuel tank 19 is secured below the motor housing 7 on the backpack carrier 2, in particular on the bottom plate 5 of the backpack carrier 2.

Figure 3:
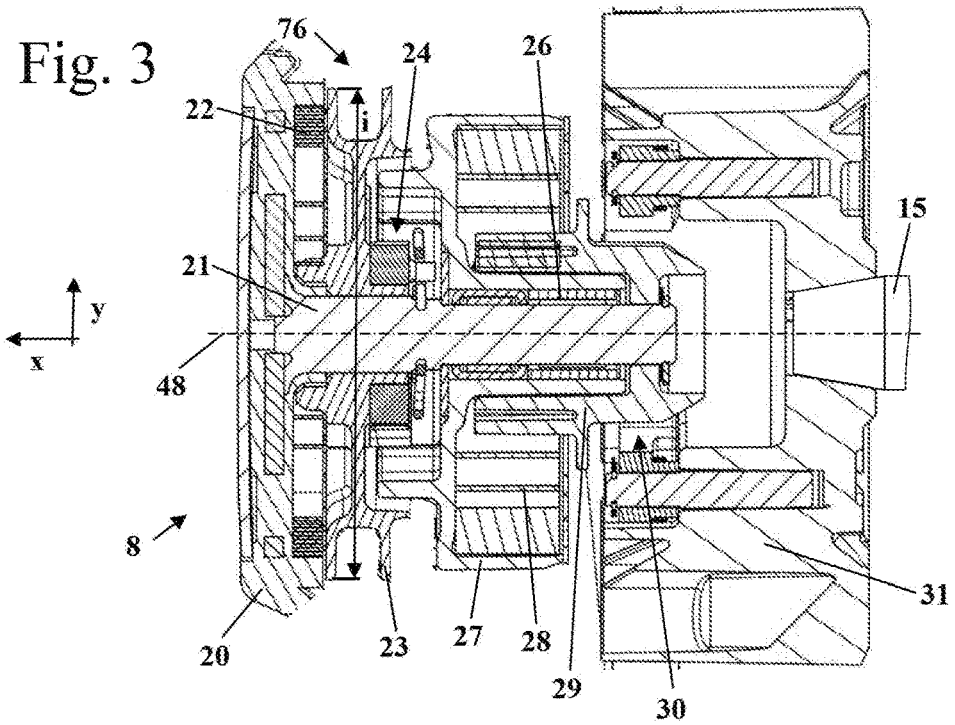
FIG. 3 is a schematic section illustration of a starter device.

FIG. 3 shows in an exemplary fashion the configuration of a recoil starter 76 of a starter device 8. The starter device 8 can however also comprise a recoil starter of a different configuration. The starter device 8 comprises a starter housing 20 on which a bearing shaft 21 of the starter device 8 is secured. On the bearing shaft 21, a rope pulley 23 is supported rotatably about axis of rotation 48. The axis of rotation 48 is the longitudinal center axis of the bearing shaft 21. Between the starter housing 20 and the rope pulley 23, a recoil spring 22 is acting that returns the rope pulley 23 into its initial position as soon as the operator 18 lets go of the starter handle 35. In the embodiment, the starter device 8 comprises additionally a spring 28 which is arranged in a spring housing 27 and is arranged in operative connection between the rope pulley 23 and the crankshaft 15. The spring stores the energy of one or a plurality of starter strokes for starting the internal combustion engine 9. The spring 28 is a spiral spring in the embodiment. The spring 28 can however also be another type of spring, in particular a coil spring. The rope pulley 23 has a diameter i that corresponds to the greatest diameter of the rope pulley 23.

In FIG. 3, a recoil starter 76 is illustrated as an embodiment in which the energy stored in the spring 28 can be stored therein by a plurality of starter strokes of the starter rope (not illustrated in FIG. 3). For this purpose, in operative connection between the starter pulley 23 and the spring housing 27, a first coupling device 24 is provided which, upon rotation of the rope pulley 23 in starting direction, produces a fixed (non-rotatable) connection relative to the spring housing 27. In the opposite direction, the first coupling device 24 is freewheeling and enables return rotation of the rope pulley 23 relative to the spring housing 27. In order to prevent that the spring 28 upon return rotation of the rope pulley 23 relaxes (loses its tension), a second coupling device 26 is provided. The second coupling device 26 prevents rotation of the spring housing 27 in a direction opposite to the starting direction and enables rotation in the starting direction. In the embodiment, the spring 28 is connected with one end to the spring housing 27 and with the other end to a follower 29. The follower 29 is connected by a third coupling device 30, in particular indirectly by means of a flywheel 31, with the crankshaft 15 of the internal combustion engine.

FIGS. 4 through 27 show the constructive configuration of the starter device 8 in detail. The description of the spatial orientation of the starter device 8 is realized based on a coordinate system which is also illustrated in FIGS. 1, 2, and 3. As shown in FIG. 1, the axis y extends in rest position 50 vertically upwardly. The axis z extends in the rest position 50 horizontally. As shown in FIG. 1 in connection with FIG. 3, the axis z in the embodiment extends perpendicular to the axis of rotation 48 of the rope pulley 23. A different orientation of the axis of rotation 48 can however be advantageous also. The axis z is oriented toward the side where the starter handle 35 is positioned. In FIG. 1, the axis of rotation 48 is also illustrated. As shown in FIG. 2, the axis x extends perpendicular to the axes y and z and from the crankshaft 15 in the direction toward the bearing shaft 21 (FIG. 3). The axes x, y, and z define a Cartesian coordinate system.

Figure 4:
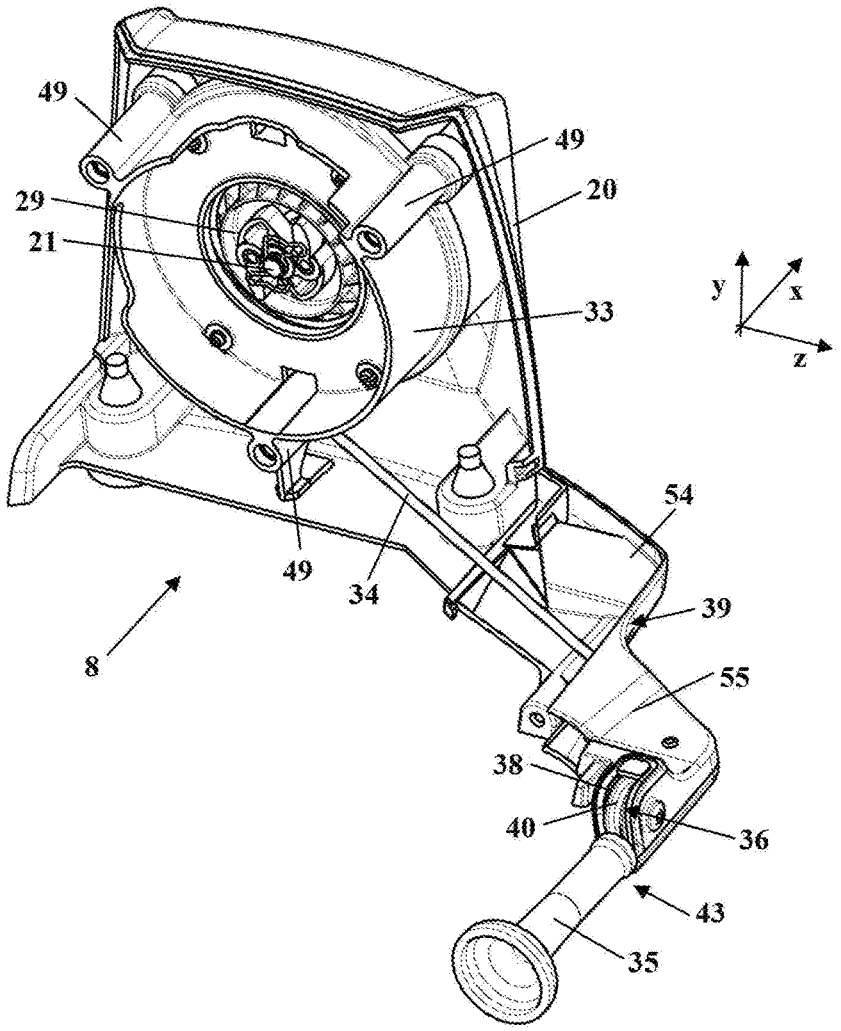
FIG. 4 is a perspective illustration of the starter device.

As shown in FIG. 4, the starter housing 20 has a laterally projecting arm 39 which is in particular projecting diagonally from the plane of the rope pulley 23. On the arm 39, a rope outlet opening 36 is arranged through which the starter rope 34 is extending and against which the starter handle 35 is resting. The starter handle 35 is arranged remote from the rope pulley 23. The starter rope 34, which is wound onto the circumference of the rope pulley 23 and which is pulled upon starting the internal combustion engine by means of the starter handle 35 in order to cause rotation of the rope pulley 23, is guided across a rope guide 38 from the recoil starter 76 to the rope outlet opening 36.

As also shown in FIG. 4, on the starter housing 20 a circumferential wall 33 is arranged that surrounds the recoil starter 76 and protects it from becoming soiled. In the embodiment, on the exterior side of the circumferential wall 33 support sleeves 49 are arranged by means of which the starter housing 20 can be screw-connected to the motor housing 7 of the blower device 1 (FIG. 1). Since the arm 39 is formed on the starter housing 20 and is fixedly connected thereto, the entire assembly can be secured as a unit on the motor housing 7. The position of the rope outlet opening 36 relative to the further components of the starter device 8, in particular relative to the bearing shaft 21 and the rope pulley 23 of the recoil starter 76 (FIG. 3), is thus constructively predetermined by the configuration of the starter housing 20.

The arm 39 comprises a first section 54 which is configured as an open shell whose open side is facing in the direction y upwardly in rest position 50 and which, in the state mounted on the motor housing 7, is contacting a bottom side of a part of the motor housing 7 and is at least partially closed by the motor housing 7. The arm 39 comprises furthermore a second section 55 which in the embodiment in cross section is approximately U-shaped and which is contacting laterally the exterior side of the motor housing 7. FIG. 4 shows the starter handle 35 in a first start position 43 in which the starter handle 35 is approximately horizontally oriented in the rest position 50 (FIG. 1).

Figure 5:
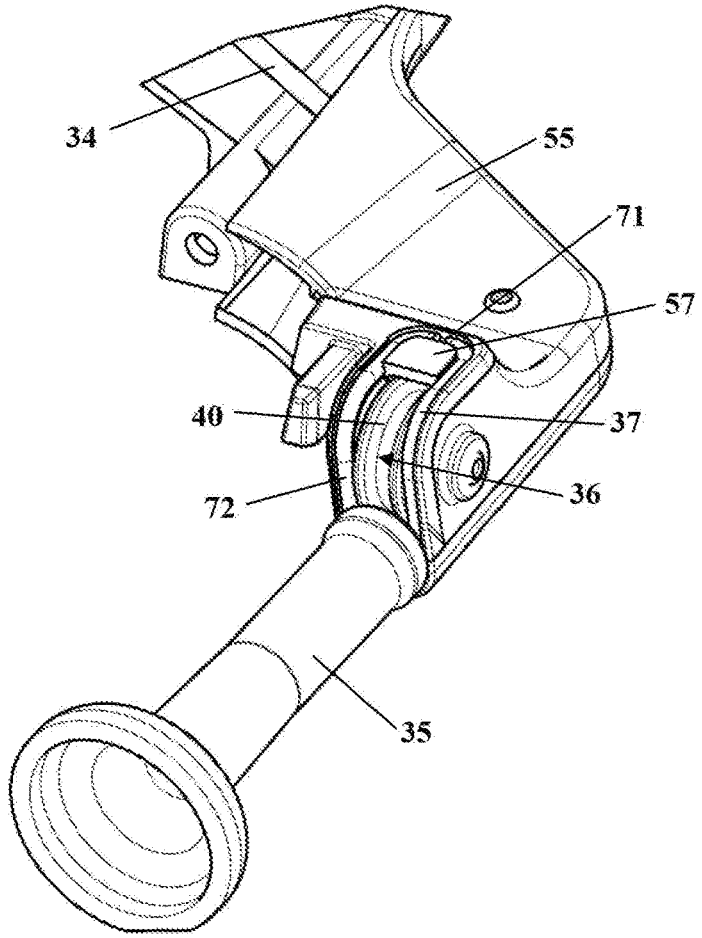
FIG. 5 is an enlarged detail view of the starter handle and of the rope outlet opening of FIG. 4.

FIG. 5 shows the configuration of the rope outlet opening 36 in detail. The rope outlet opening 36 comprises in the embodiment an approximately rectangular cross section with two longitudinal sides and two narrow sides. At the rope outlet opening 36, a guide element 37 is arranged that delimits the rope outlet opening 36. The guide element 37 is arranged on the starter housing 20. The guide element 37 can be completely or partially formed by the starter housing 20.

In the embodiment, a housing-fixed part 57 of the guide element 37 is provided which is formed on the starter housing 20. The housing-fixed part 57 delimits the rope outlet opening 36 only at a second narrow side which, in the second end position of the starter handle 35, is closer to the starter handle 35. In the embodiment, a further part of the guide element 37 is formed by an insert that is secured on the starter housing 20 so as to be advantageously exchangeable. The insert delimits at least the longitudinal sides of the rope outlet opening 36 as well as a first narrow side which in the first end position of the starter handle 35 is closer to the starter handle 35.

When the starter handle 35 is not pulled in the plane of the first deflection roller 40, the rope can rub on the part of the guide element 37 which is embodied as the insert. In order to minimize friction and to prevent the starter rope 34 from cutting into the guide element 37, the edges of the insert are rounded. The insert is advantageously formed of a material that is different from the material of the starter housing 20. The insert is advantageously designed as a slotted wire ring 72 which is bent about axis 45. The insert in the embodiment is a metallic bent part. The slot of the wire ring 72 is positioned at the second narrow side of the rope outlet opening 36. When performing a starter stroke, the second narrow side in general is not contacted by the starter rope 34. The wire ring 72 is in particular secured with slight pretension on the starter housing 20.

Figure 6:
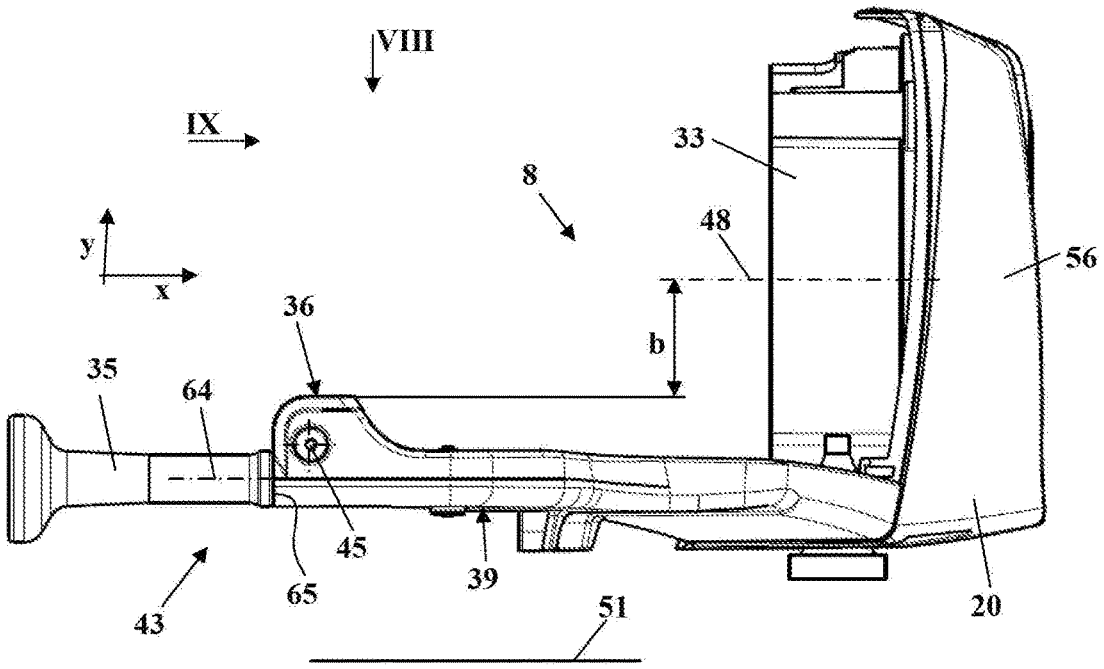
FIG. 6 is a side view of the starter device.

FIG. 6 shows a side view of the starter device 8. As shown in FIG. 6, the arm 39 in this side view extend substantially in the direction x. In the direction y, the arm 39 has only a minimal extension. The starter housing 20 comprises a cover section 56 on which the circumferential wall 33 is provided and on which also the bearing shaft 21 (FIG. 4) is secured. The arm 39 projects away from the cover section 56. As shown in FIG. 6, the rope outlet opening 36 in rest position 50, i.e., corresponding to the position of the starter device 8 shown in FIG. 6, is arranged below the axis of rotation 48, i.e., closer to the support surface 51. In direction y, the rope outlet opening 36 has a spacing b relative to the axis of rotation 48. The spacing b is greater than one fourth of the length of the diameter i of the rope pulley 23 (FIG. 3). In the embodiment, the spacing b amounts to approximately half the length of the diameter i. As shown also in FIG. 6, a bottom side 65 of the starter handle 35 which is facing the arm 39 is contacting the rope outlet opening 36, i.e., is resting against the guide element 37 which is not visible in the view of FIG. 6. On the bottom side 65 the starter rope 34 enters the starter handle 35. The rope guide 38 comprises in the embodiment a deflection roller 40 which is rotatably supported about axis 45. The deflection roller 40 can also be connected rigidly to the starter housing 20. The starter rope 34 comprises a longitudinal center axis 64 in the section which adjoins the starter handle 35. In the embodiment, the longitudinal axis 64 coincides with the longitudinal center axis of the starter handle 35. The longitudinal center axis 64 extends in the position illustrated in FIG. 6, in the rest position 50, parallel to the support surface 51. In the rest position 50, the longitudinal center axis 64 in the embodiment is positioned advantageously at an angle of less than 15°, in particular less than 10°, relative to the support surface 51.

Figure 7:
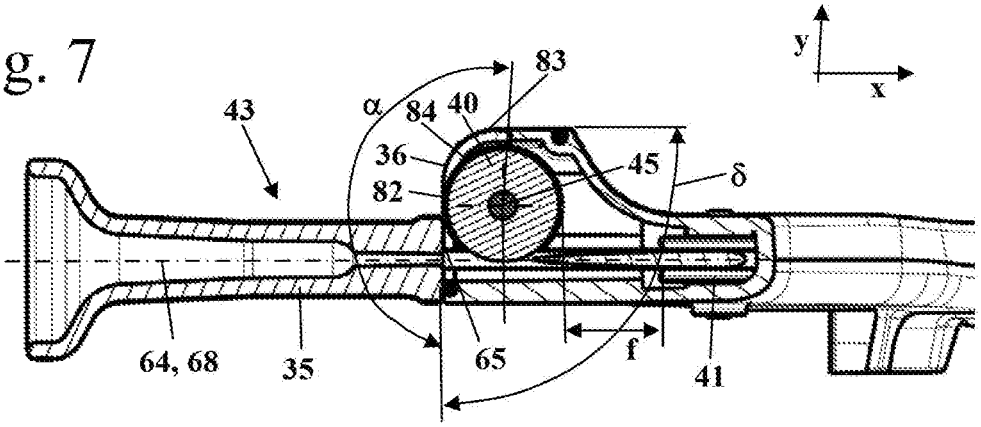
FIG. 7 is an enlarged section illustration of the region of the starter handle and of the rope outlet opening of FIG. 6.

FIG. 7 shows the configuration of the rope outlet opening 36 in detail. The rope outlet opening 36 extends in the embodiment along the circumference and in axial direction of the deflection roller 40. In this context, the rope outlet opening 36 extends about the first deflection roller 40 along a circumferential section 84 across a peripheral angle α that amounts to at least 60°. The peripheral angle α is measured about the axis 45 of the first deflection roller 40 between the connecting lines of the ends of the rope outlet opening 36 with the axis 45. The peripheral angle α is thus measured between two radials relative to the axis 45 that extend each from the axis 45 to the tangential outer end of the rope outlet opening 36. The peripheral angle α amounts advantageously to at least 60°, in particular at least 90°, advantageously at least 100°, preferably at least 110°. In the embodiment, the peripheral angle α is greater than 120°. The rope outlet opening 36 extends in an arc shape at least in a central section. At the bottom side 65 (FIG. 7), the rope outlet opening 36 or the guide element 37 extends in the first start position 43 illustrated in FIG. 7 parallel to the bottom side 65. In the embodiment, the bottom side 65 of the starter handle 35, the rope outlet opening 36, and the guide element 37 delimiting the rope outlet opening 36 in the region adjoining the bottom side 65 extend in direction y.

The rope outlet opening 36 comprises in the embodiment a first section 82 and a second section 83. The starter handle 35 is facing with its bottom side 65 the first section 82 in a first end position and is facing with its bottom side 65 the second section 83 in a second end position. The first section 82 and the second section 83 are positioned angularly relative to each other about the axis 45. The sections 82 and 83 are positioned at an angle δ relative to each other; the angle δ amounts advantageously to less than 90°, preferably less than 70°, in particular amounts to approximately 60°. In the embodiment, an angle δ of approximately 90° is provided. Advantageously, the first and second sections 82 and 83 are flat and an arc-shaped section between them is provided which is approximately following the circumference of the deflection roller 40. In the embodiment, the first section 82 and the second section 83 have different spacings to the axis 45 of the deflection roller 40. In the embodiment, the first section 82 is positioned closer to the axis 45 than the second section 83. A course of the rope outlet opening 36 that follows exactly the circumference of the deflection roller 40 can be advantageous also. In the embodiment, the deflection roller 40 is not projecting past the rope outlet opening 36. As also shown in FIG. 7, the first deflection roller 40 comprises a spacing f relative to a second deflection roller 41 which will be described in the following in more detail.

Figure 8:
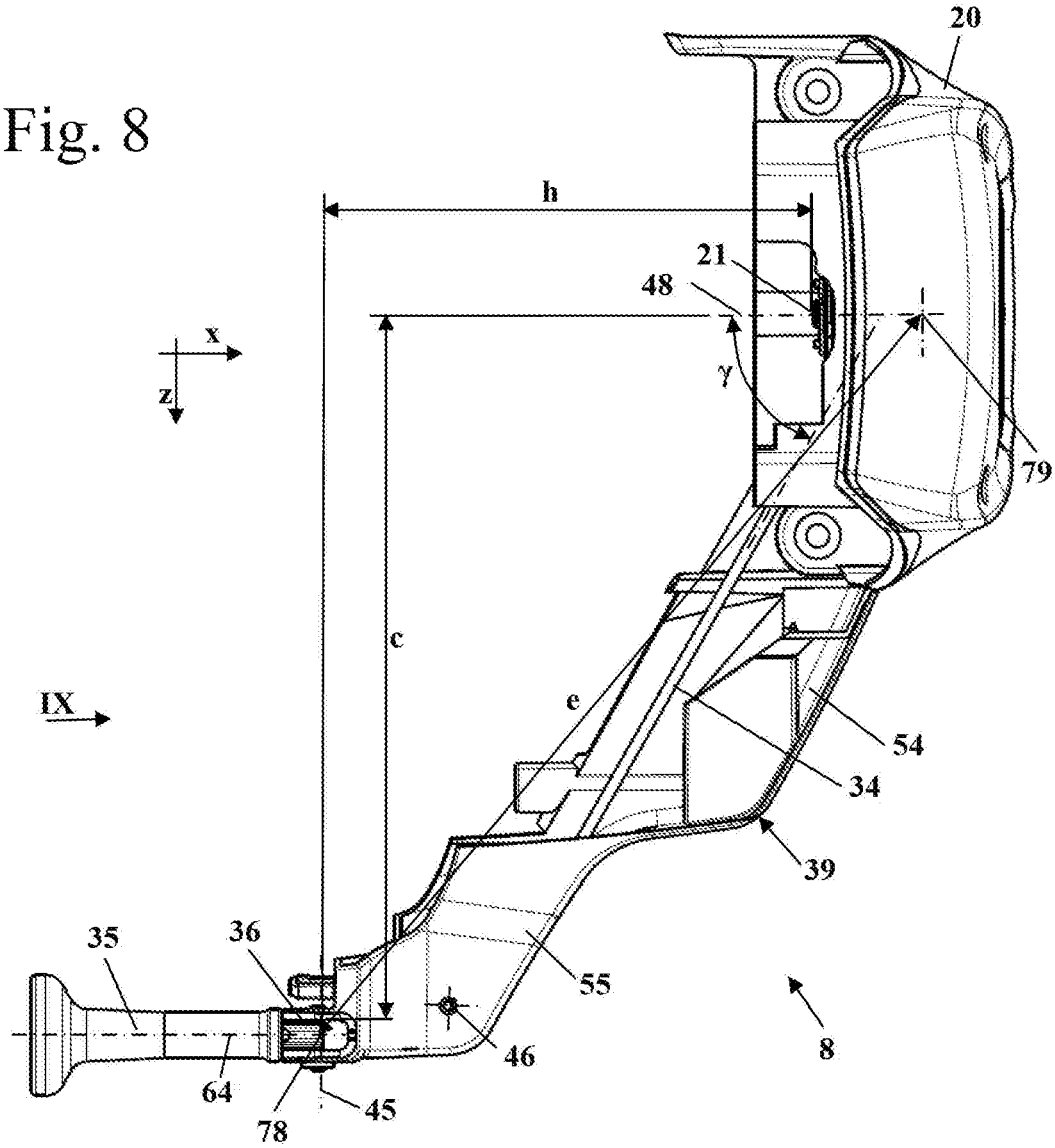

FIG. 8 shows the starter device 8 in a plan view in the direction y. As shown in FIG. 8, the rope outlet opening 36 has a spacing c in the direction z relative to the axis of rotation 48 of the rope pulley 23. The spacing c is advantageously greater than the length of the diameter i of the rope pulley 23. In the embodiment, the spacing c is more than twice, advantageously more than 2.5 times, as large as the length of the diameter i (FIG. 3). In the direction x, the rope outlet opening 36 has a spacing h relative to the bearing shaft 21. The spacing h is advantageously comparatively large and is longer than the length of the diameter i of the rope pulley 23. In the embodiment, the spacing h in the direction x amounts to approximately 1.5 times to 2 times the length of the diameter i of the rope pulley 23. The spacing h is measured in this context relative to the end face of the bearing shaft 21. The center point 78 of the deflection roller 40 and the center point 79 of the rope pulley 23 have a spacing e relative to each other that amounts advantageously to at least 1.5 times, in particular at least 2 times, the length of the diameter i of the rope pulley 23. The center points 78 and 79 are the geometric centers of the deflection roller 40 and of the rope pulley 23, respectively.

The cable guide 38 comprises also the second deflection roller 41 (FIG. 13) whose axis 46 is illustrated in FIG. 8. FIG. 8 shows that the axes 45 and 46 of the deflection rollers 40 and 41 are positioned perpendicular to each other. The axis 45 of the deflection roller 40 extends in the direction z and the axis 46 of the deflection roller 41 in the direction y. The coordinate system can also be defined by the axes 45 and 46, in particular for a different position of the axes 45 and 46 relative to the rest position 50. In this context, the direction z is extending in the direction of the axis 45 and the direction y is extending in the direction of the axis 46. As also shown in FIG. 8, the starter rope 34, extending from the rope pulley 23 to the second deflection roller 41, is guided relative to the axis of rotation 48 of the rope pulley 23 at an angle γ that opens toward the starter handle 35 and amounts to 20° to 80°, advantageously 40° to 75°, in the x-z plane as shown in FIG. 8. In the embodiment, the angle γ is approximately 60°.

Figure 9:
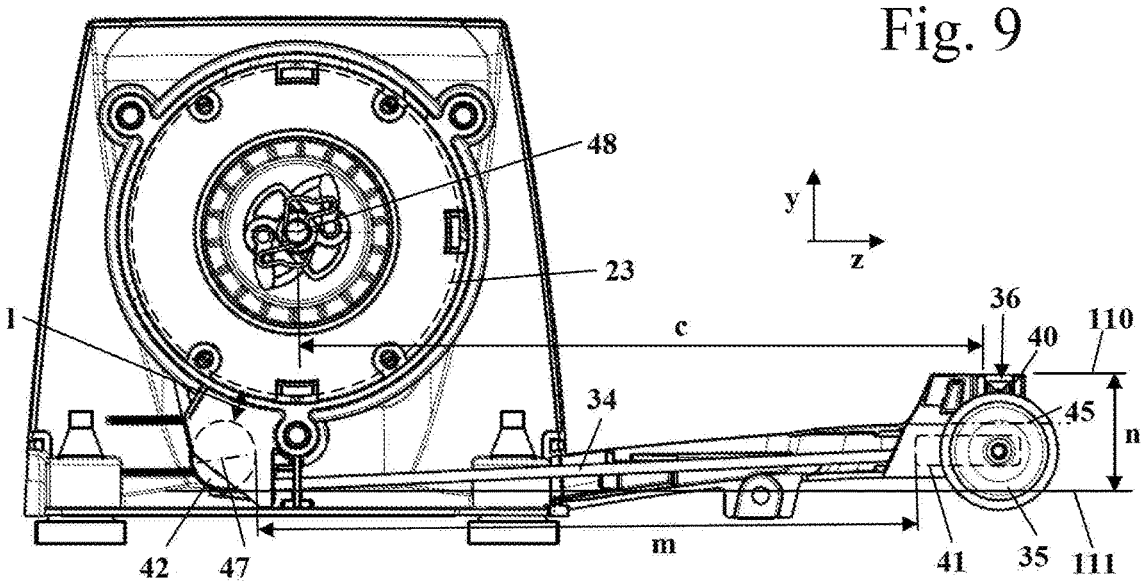
FIG. 9 is a side view in the direction of arrow IX of FIG. 6.

FIG. 9 shows schematically a third deflection roller 42 which is arranged adjacent to the rope pulley 23 and below the rope pulley 23 in the embodiment. The third deflection roller 42 has a spacing l relative to the rope pulley 23. The third deflection roller 42 has an axis 47. In the embodiment, all deflection rollers 40, 41, 42 are rotatable about their respective axis 45, 46, 47. The deflection rollers 40, 41, and 42 can however also be fixedly connected to the starter housing 20. In the rest position 50, the axis 47 of the third deflection roller 42 is advantageously closer to the support surface 51 than the axis 45 of the first deflection roller 40. Advantageously, all deflection rollers 40, 41, and 42 in the rest position 50 are closer to the support surface 51 than the rope pulley 23. Expediently, all deflection rollers 40, 41, and 42 are positioned between two planes 110 and 111 that are parallel to the support surface 51 and which have a spacing n relative to each other that is smaller than half the length of the diameter i of the rope pulley 23. The spacing f between the first deflection roller 40 and the second deflection roller 41 (FIG. 7) and the spacing l between the third deflection roller 42 and the rope pulley 23 are advantageously smaller than the length of the diameter i of the rope pulley 23, in particular smaller than half the length of the diameter i. The second deflection roller 41, schematically illustrated in FIG. 9, and the third deflection roller 42, schematically illustrated in FIG. 9, have a spacing m relative to each other. The spacing m between the second deflection roller 41 and the third deflection roller 42 is advantageously at least twice as large as each of the spacings f and l.

Figure 10:
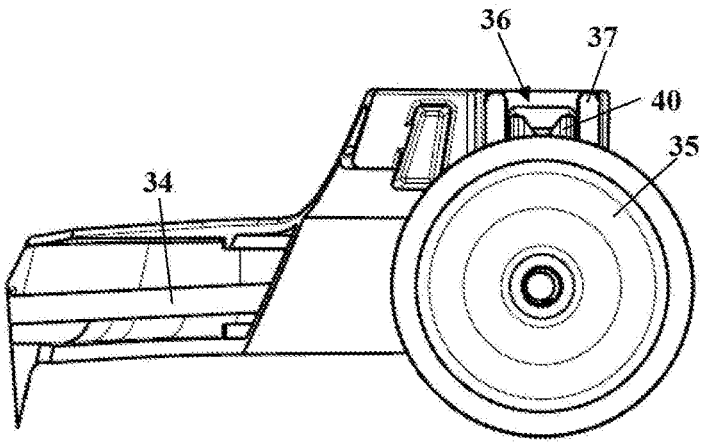
FIG. 10 is an enlarged illustration of the region of the starter handle of FIG. 9.
Figure 28:
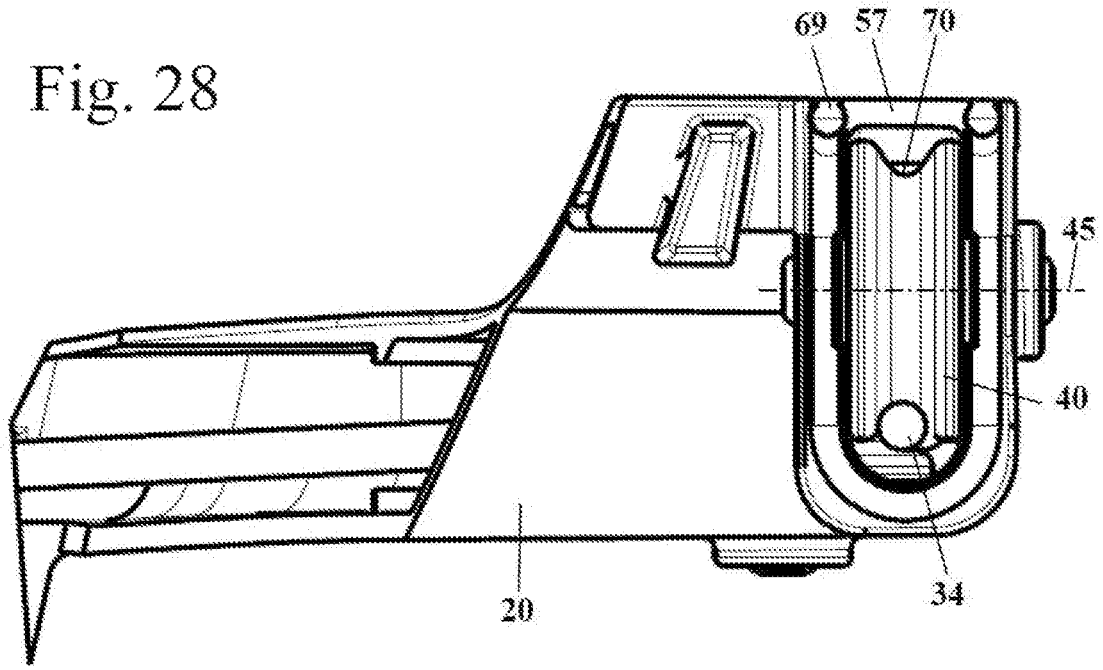
FIG. 28 is a side view in the direction of arrow XXVIII of FIG. 26.

As illustrated in FIG. 10, the guide element 37 extends on both longitudinal sides of the rope outlet opening 36. The deflection roller 40 is in particular arranged centrally between the two longitudinal sides of the guide element 37. The arrangement of a receptacle 69 for the guide element 37 on both longitudinal sides of the rope outlet opening 36 is illustrated in FIG. 28.

Figure 11:
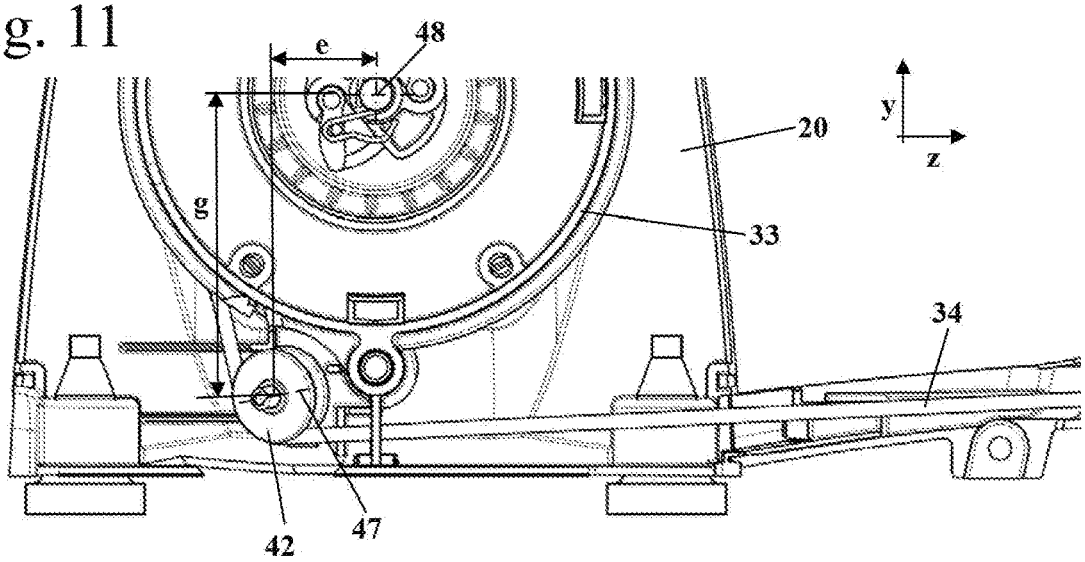
FIG. 11 is a side view corresponding to the illustration of FIG. 9 with a cover removed from the third deflection roller.

As shown in FIG. 11, the third deflection roller 42 has also a spacing relative to the axis of rotation 48 in the direction y. The axis 47 of the third deflection roller 42 has a spacing g relative to the axis of rotation 48 which in the embodiment is somewhat greater than half the length of the diameter i of the rope pulley 23. The third deflection roller 42 is arranged adjacent to the circumferential wall 33 on the exterior side of the circumferential wall 33. The third deflection roller 42 in this context is father removed from the starter handle 35 in the direction z than the axis of rotation 48. Relative to the axis of rotation 48 in the direction z, the third deflection roller 42 comprises a spacing e which in the embodiment is smaller than the length of the diameter i, in particular smaller than half the length of the diameter i. The spacing e amounts advantageously to 0.1 times to 0.4 times the length of the diameter i.

Figure 12:
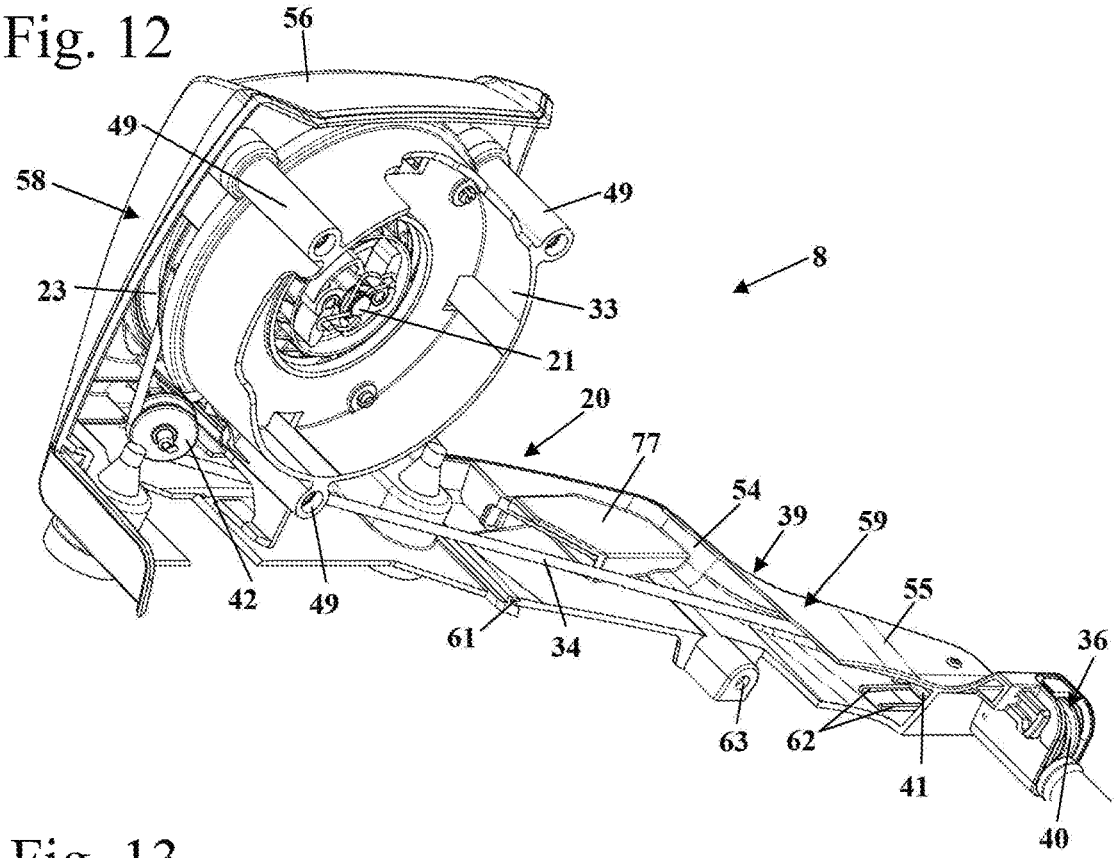
FIG. 12 is a perspective illustration of the starter device.
Figure 13:
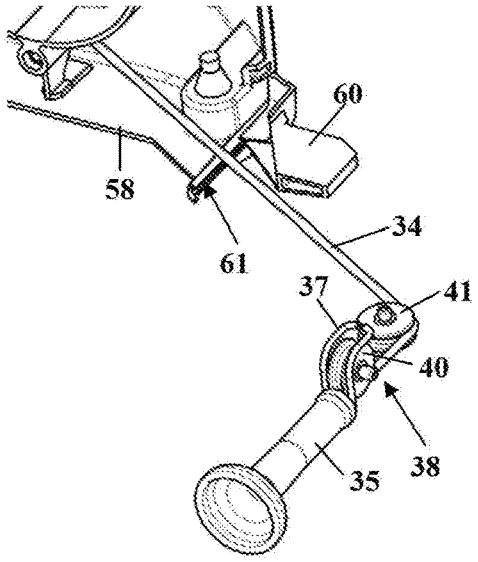
FIG. 13 is a perspective illustration of the rope guide of the starter device with only partially illustrated starter housing.

FIG. 12 shows the configuration of the starter housing 20 in detail. The starter housing 20 comprises a first housing part 58 which forms substantially the cover section 56 and the circumferential wall 33 as well as the support sleeves 49. On the first housing part 58, the bearing shaft 21 of the starter device 8 together with all components supported on the bearing shaft 21 as well as the third deflection roller 42 are secured. The region of the first housing part 58 covering the deflection roller 42 is not illustrated in FIG. 11 and FIG. 12 but is visible in FIG. 9. On the first housing part 58 also a connecting member 60 (FIG. 13) is formed that projects into a connecting pocket 77 of the arm 39. As shown in FIG. 13, the connecting member 60 is configured as a hollow profile, in the embodiment with a substantially rectangular cross-section.

A second housing part 59 forms the arm 39. The separating location between the first housing part 58 and the second housing part 59 is located approximately centrally between the second deflection roller 41 and the third deflection roller 42. The second housing part 59 is inserted into a receiving groove 61 of the first housing part 58 and the first housing part 58 projects with its connecting member 60 into the connecting pocket 77 of the second housing part 59. The housing parts 58 and 59 are secured with form fit on each other in the direction x and in the direction y.

Figure 32:
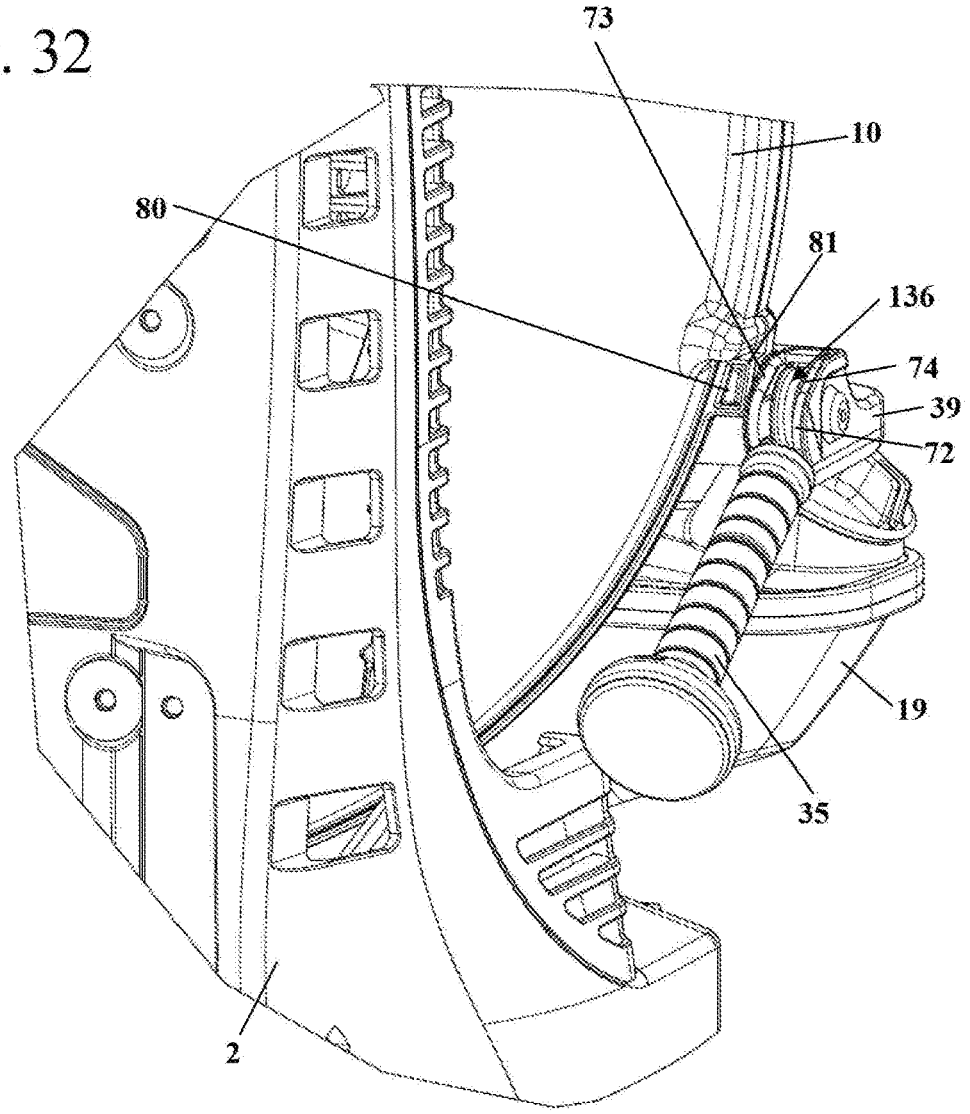
FIG. 32 is a perspective illustration of the region of the starter handle of the blower device of FIG. 29.

For fixation of the arm 39, an appendage 80 is provided which is inserted into a receptacle 81 (FIG. 32) on the blower spiral 10. The receptacle 81 is shown in FIG. 32 for a blower device 101; it is provided on the blower device 1 in a corresponding manner.

Figure 31:
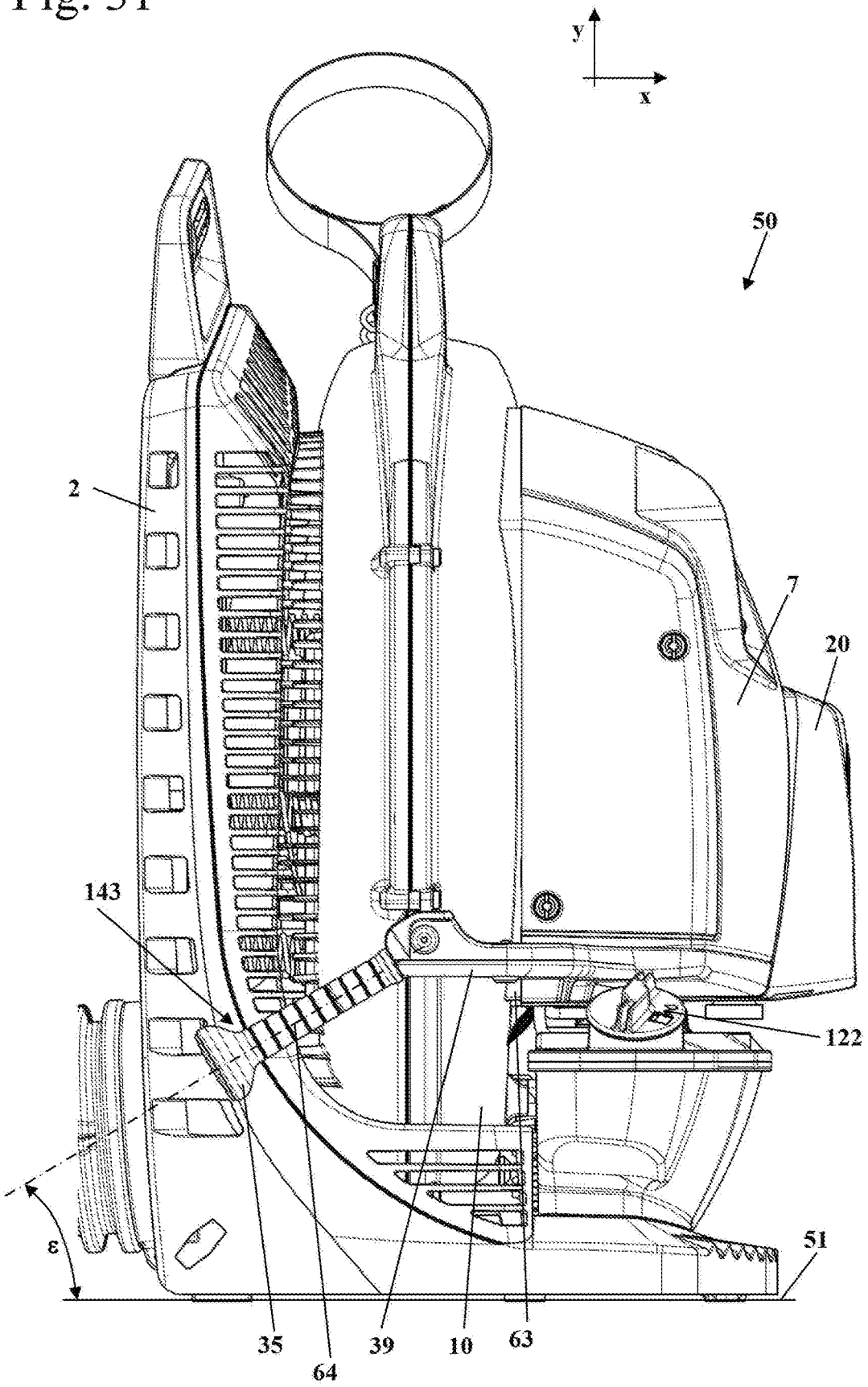
FIG. 31 is a side view in the direction of arrow XXXI of FIG. 29.

On the second housing part 59, advantageously a screw connection sleeve 63 is formed with which the starter housing 20 can also be screw-connected to the motor housing 7 or to the blower spiral 10. For the further embodiment of the blower device, the arrangement of the screw connection sleeve 63 on the blower spiral 10 is illustrated in FIG. 31. By fixation of the two housing parts 58 and 59 on the motor housing 7 and/or on the blower spiral 10, an additional positional securing action of the two housing parts 58 and 59 relative to each other is achieved. As also shown in FIG. 12, reinforcement ribs 62 are formed in the second housing part 59 in the second section 55 in the region of the second deflection roller 41. The reinforcement ribs 62 form at the same time a contact surface for the second deflection roller 41.

FIG. 13 shows the configuration of the receiving groove 61 and of the connecting member 60. The second housing part 59 is not illustrated so that the position of the deflection rollers 40 and 41 relative to each other as well as the configuration of the insert of the guide element 37 can be seen clearly. The deflection rollers 40, 41, and 42 (FIG. 12) are part of the rope guide 38. Also, the guide element 37 on which the rope outlet opening 36 is formed is part of the rope guide 38.

Figure 14:
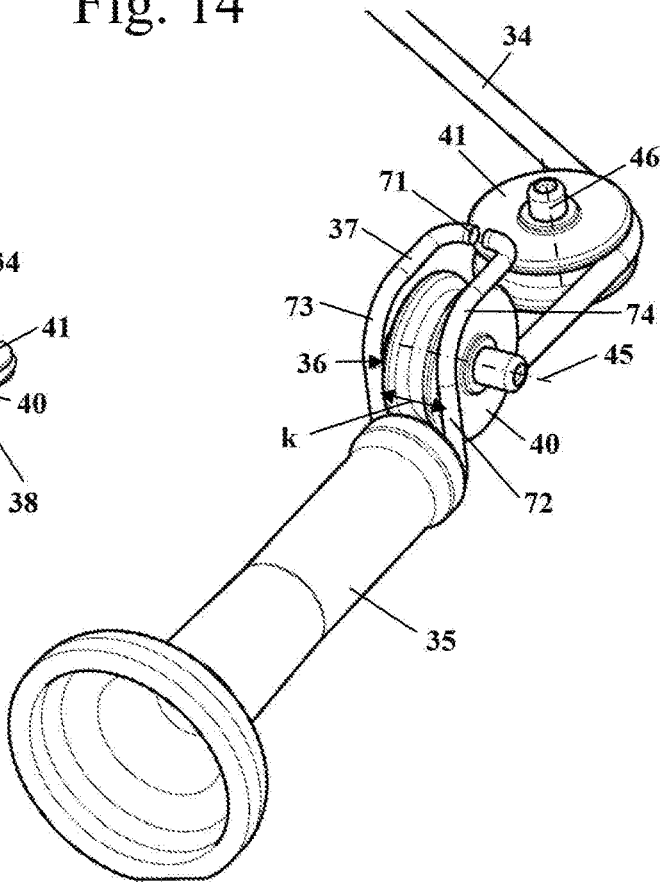
FIG. 14 is an enlarged detail illustration of the arrangement of FIG. 13.
Figure 15:
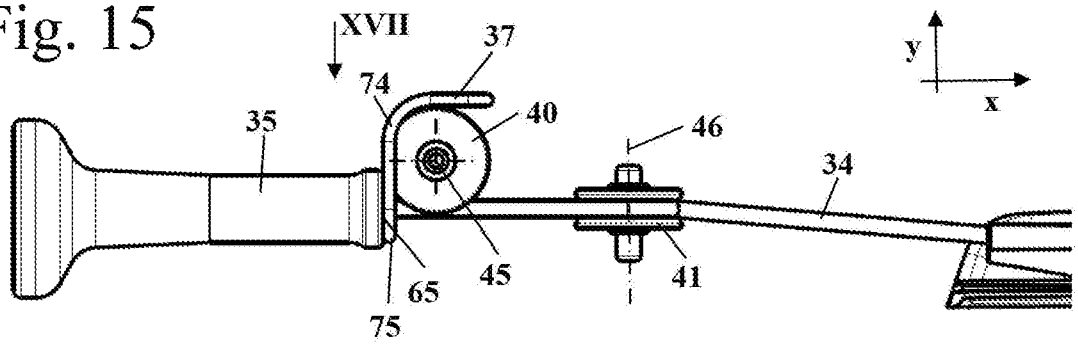
FIG. 15 is a side view of the rope guide with only partially illustrated starter housing.

As shown in FIG. 14, the guide element 37 is advantageously formed as an angled wire ring 72 in the region where the starter rope 34 is contacting preferably. The wire ring 72 comprises in the embodiment a shape that is deviating from a circular shape. The wire ring 72 can preferably be interrupted, in particular it can be slotted. The wire ring 72 has two legs 73 and 74 that are extending at a spacing k relative to each other. The spacing k is advantageously constant across at least 50%, in particular at least 80%, of the length of the legs 73 and 74. The spacing k corresponds to the width of the rope outlet opening 36. In a viewing direction extending in the direction x, the two legs 73 and 74 extend congruently above each other, as shown in FIG. 15 in connection with FIG. 14. As also shown in FIG. 15, the two legs 73 and 74, in the region where the starter handle 35 is contacting in the first start position 43, are connected to each other by an arc-shaped connecting part 75. In the first start position 43, the starter handle 35 is in a first end position. This first start position 43 is shown in FIG. 15. The bottom side 65 of the starter handle 35 is contacting the guide element 37, i.e., is resting against the arc-shaped connecting part 75 as well as against the regions of the legs 73 and 74 adjoining the arc-shaped connecting part 75 (FIG. 15). The wire ring 72 is slotted in the region opposite the arc-shaped connecting part 75.

Figure 16:
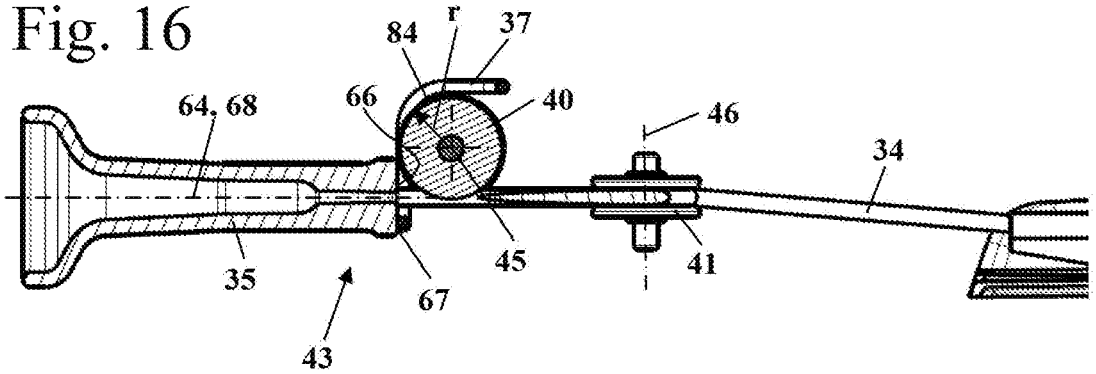
FIG. 16 is a section view of the arrangement of FIG. 15.

As shown in FIG. 16, the starter handle 35 has a center plane 68 which is extending parallel to the axis 45 of the first deflection roller 40 and which contains the longitudinal center axis 64 of the starter rope 35 at the bottom side 65. The bottom side 65 has a first side 66 which is arranged on the side of the center plane 68 which is facing the axis 45 of the first deflection roller 40. The bottom side 65 has also a second side 67 which is arranged on the side of the center plane 68 which is facing away from the axis 45. As shown in FIG. 16, the bottom side 65 in the first end position of the starter handle 35 is resting with the first side 66 as well as with the second side 67 against the guide element 37. The first start position 43 is therefore a stable end position for the starter handle 35. FIGS. 15 and 16 also show the perpendicular orientation of the axes 45 and 46 relative to each other. The axis 45 extends in this context parallel to the direction z and the axis 46 extends parallel to the direction y. As also shown in FIG. 16, the circumferential section 84 along which the rope outlet opening 36 is extending has a radius r. The radius r is constant in the embodiment, due to the circular cross section of the deflection roller 40. A different cross section of the circumferential section 84 can however be advantageous also. The radius r indicates the minimal radius in the circumferential section 84 where the rope outlet opening 36 is extending. The radius r amounts advantageously to at least 8 mm, in particular at least 13 mm. The radius r is greater than a diameter d (FIG. 17) of the starter rope 34. In the embodiment, the radius r is greater than twice the length of the diameter d of the starter rope 34.

Figure 17:
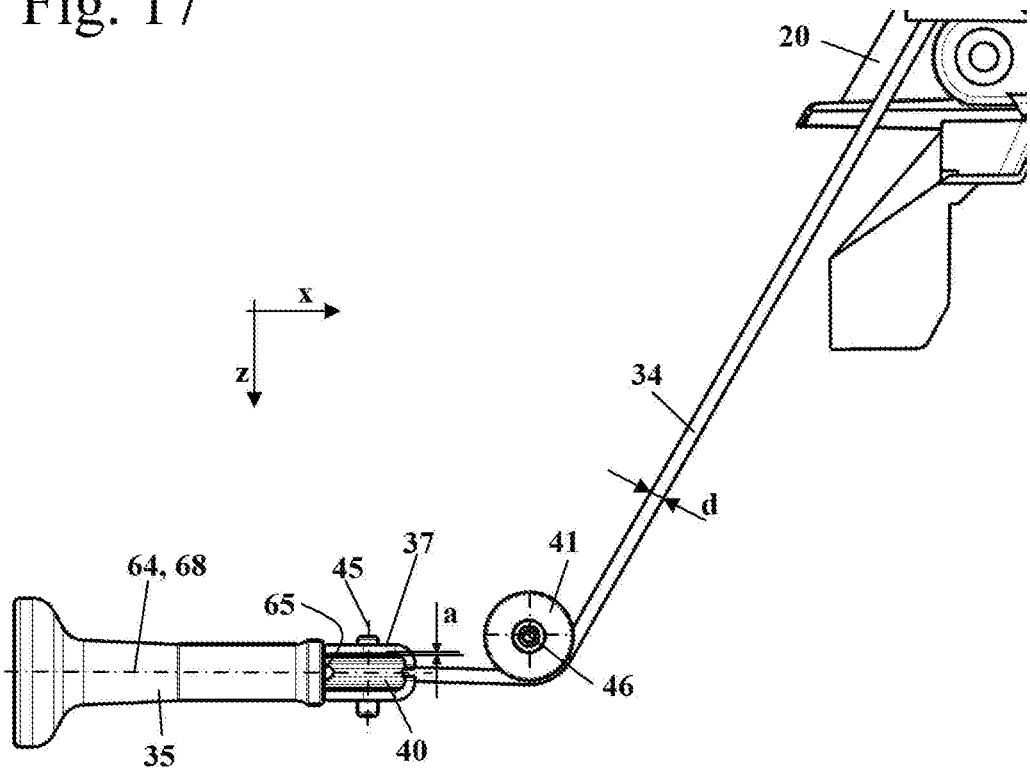
FIG. 17 is a plan view in the direction of arrow XVII of FIG. 15.
Figure 18:
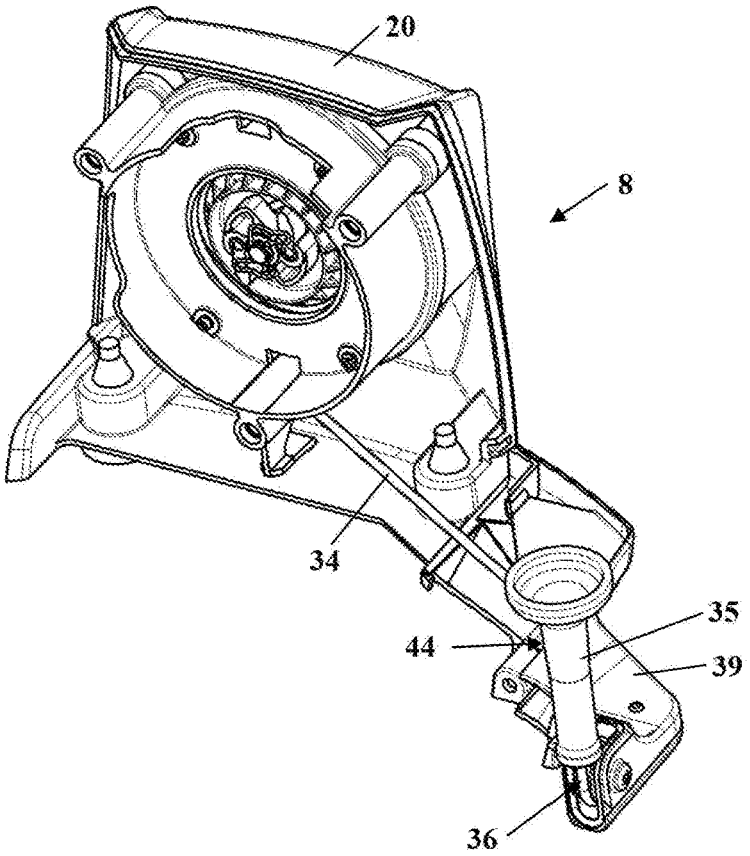
FIG. 18 is a perspective illustration of the starter device with the starter handle in a second start position.

As shown in FIG. 17, the deflection roller 40, viewed in the direction y, i.e., in a plan view on a plane x-z as illustrated in FIG. 17, has a spacing a relative to the guide element 37; this spacing a is measured parallel to the axis 45. The spacing a is advantageously smaller than the length of the diameter d of the starter rope 34. In the embodiment, the spacing a is significantly smaller than the length of the diameter d. The spacing a amounts advantageously to less than half, in particular less than one fourth, of the length of the diameter d. The spacing a is measured from the guide element 37, in particular from leg 73, 74 of the guide element 37, to a lateral face of the first deflection roller 40 in the direction of the axis 45. Jamming of the starter rope 34 between the lateral faces of the deflection roller 40 and the guide element 37 is thus avoided.

Figure 19:
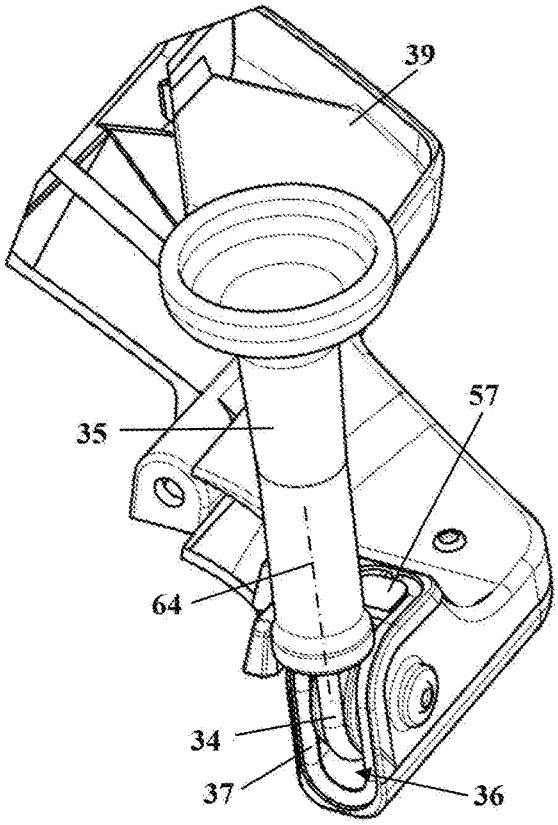
FIG. 19 is a perspective detail illustration of the region of the starter handle of FIG. 18.
Figure 20:
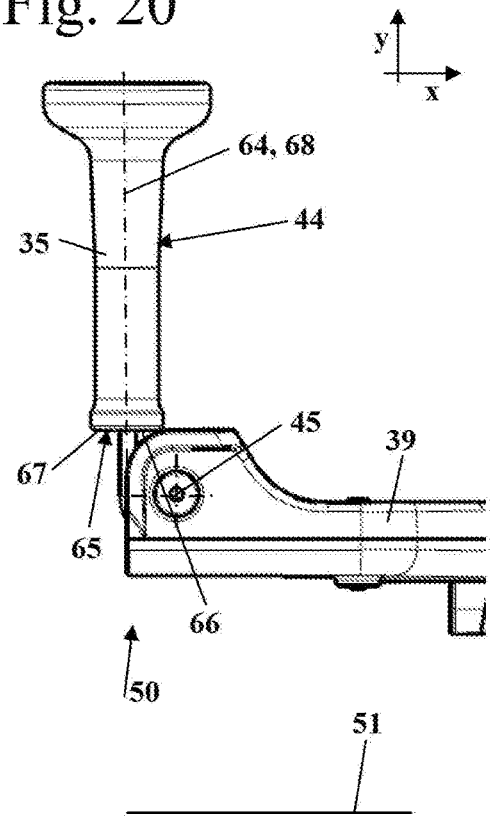
FIG. 20 is a side view of the region of the starter handle of FIGS. 18 and 19.

FIGS. 18 to 24 show the starter handle 35 in a second start position 44. In the second start position 44, the operator can comfortably pull the starter handle 35 in upward direction in the rest position 50 (FIG. 1) of the blower device 1. As shown in FIGS. 19 and 20, immediately adjacent to the starter handle 35 the longitudinal center axis 64 of the starter rope 34 is extending vertically in the second start position 44 in the rest position 50. In the second start position 44, the longitudinal center axis 64 of the starter rope 34 can also extend at a slant away from the rope pulley 23. In the rest position 50, the longitudinal center axis 64 is thus positioned at an angle of less than 15°, in particular less than 10°, relative to the vertical. As shown in FIG. 20, the bottom side 65 of the starter handle 35 is only contacting with the first side 66 the guide element 37 in the second start position 44 (FIG. 19). The second side 67 is exposed. The bottom side 65 of the starter handle 35 is positioned at most across one half of its circumference on the guide element 37. When a pulling force is acting on the starter rope 34, as it is exerted by the recoil spring 22 (FIG. 3), the starter handle 35 is pulled back into the first start position 43. In the embodiment, the second start position 44 is also an end position of the starter handle 35.

Figure 22:
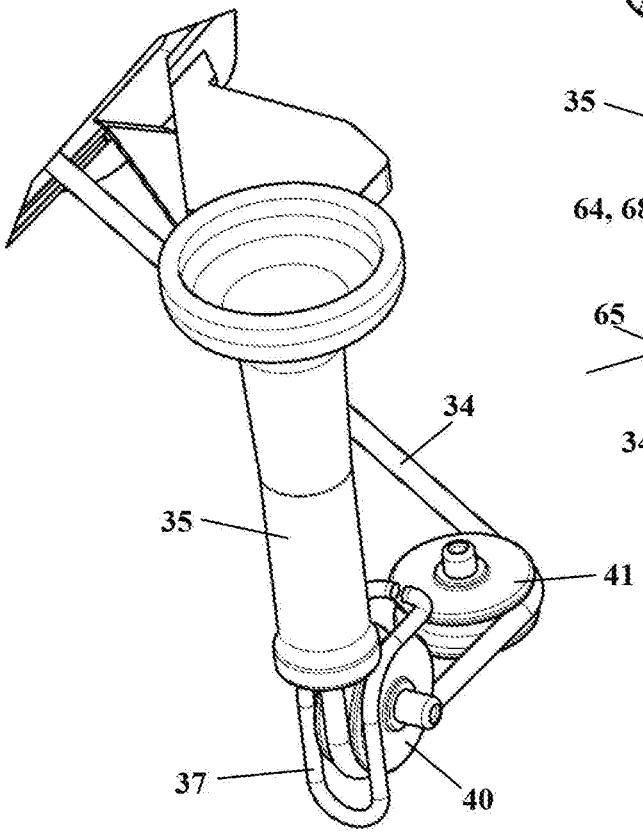
FIG. 22 is a perspective illustration of the arrangement of FIGS. 18 to 21 with only partially illustrated starter housing.
Figure 21:
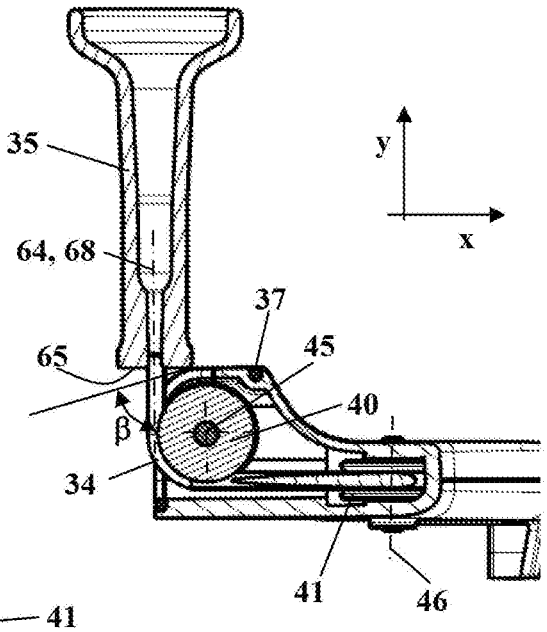
FIG. 21 is a section illustration of the starter handle of FIG. 20.
Figure 23:
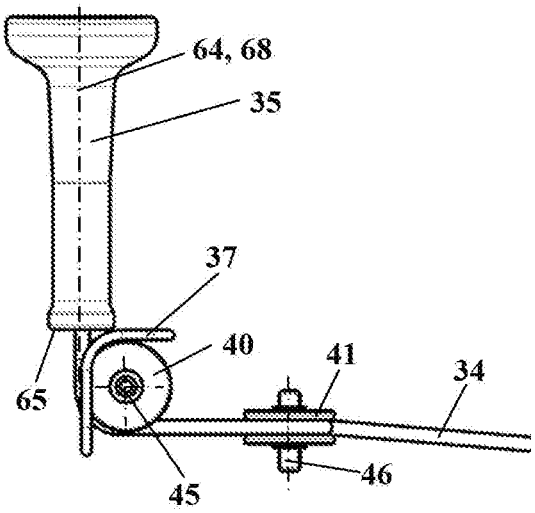
FIG. 23 is a side view of the arrangement of FIG. 22.
Figure 24:
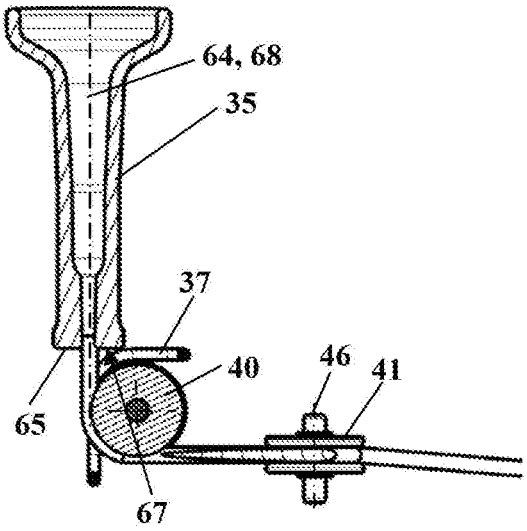
FIG. 24 is a section view of the arrangement of FIG. 23.

As shown in FIG. 21, the guide element 37 extends in the contact area where the bottom side 65 rests on the guide element 37 at an angle β relative to the longitudinal center axis 64 of the starter rope 34; this angle β is smaller than 90°. The angle β opens toward the side which is facing away from the axis 45 and the starter handle 35. The angle β is measured outside of the rope outlet opening 36 at the side of the rope outlet opening 36 that is facing away from the deflection roller 40. Due to the slanted extension of the guide element 37 in the region in which the starter handle 35 is resting in the second start position 44, a pulling force acting on the starter rope 34 causes an adjustment of the starter handle 35 into the first start position 43. The position of the starter handle 35 in the second start position 44 is also shown in FIGS. 22 to 24.

Figure 25:
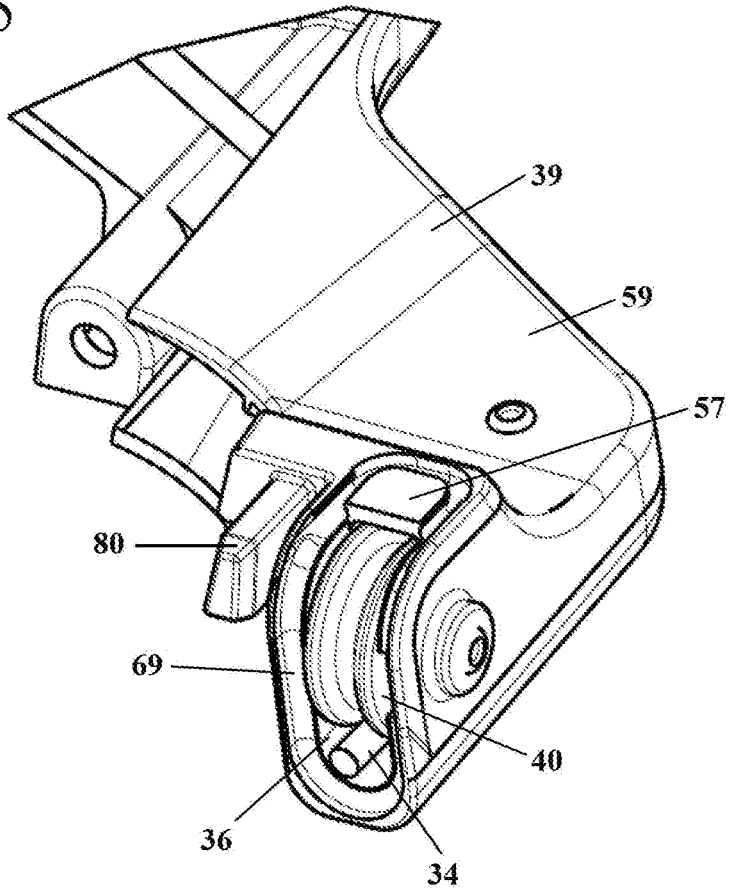
FIG. 25 is a perspective illustration of the region of the rope outlet opening without the starter handle.
Figure 26:
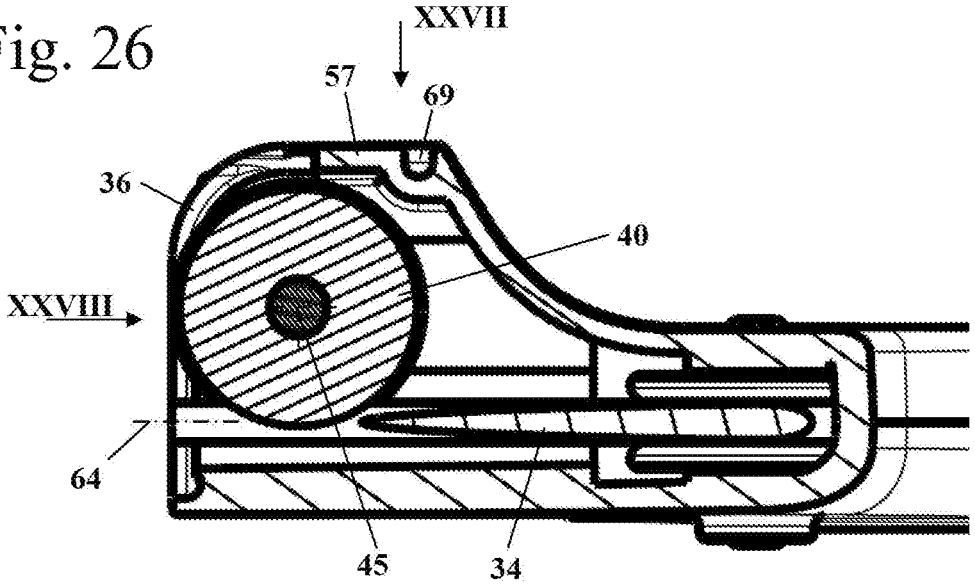
FIG. 26 is a section view of the arrangement of FIG. 25.
Figure 27:
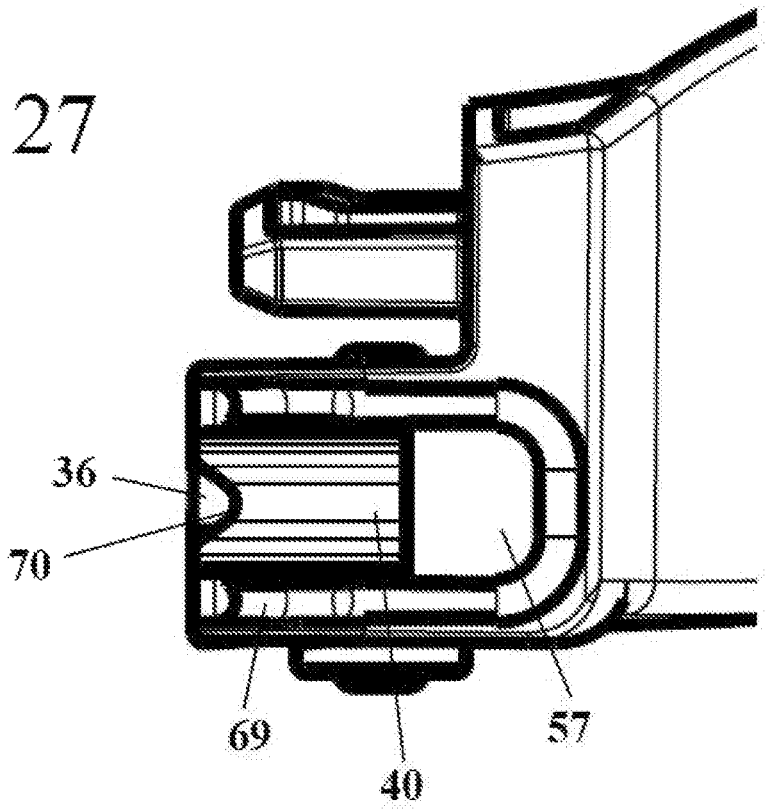
FIG. 27 is a side view in the direction of arrow XXVII of FIG. 26.

FIGS. 25 to 28 show the arrangement without the starter handle 35 wherein the starter rope 34 is arranged in the position that is correlated with the first start position 43. The exchangeable part of the guide element 37, which is the wire ring 72 in the embodiment, is not shown. As shown in FIGS. 25 to 27, a receptacle 69 for the exchangeable part of the guide element 37 is provided on the second housing part 59. The receptacle 69 is embodied as a circumferential groove which surrounds the rope outlet opening 36. In the region of the second narrow side of the rope outlet opening 36 which is positioned in the second end position 44 of the starter handle 35 closer to the starter handle 35, the receptacle 69 narrows toward the exterior side and has in particular an undercut. In the region of the second narrow side of the rope outlet opening 36, the housing-fixed part 57 of the guide element 37 is positioned. Therefore, the guide element 37 can be clipped into the receptacle 69. The ends of the insert (wire ring 72) are positioned adjacent to the second narrow side and do not contact the starter rope 34. The insert is in particular mounted with slight pretension on the starter housing 20. The insert is advantageously secured in the undercut by a clamping action. Advantageously, the legs of the insert are pushed toward each for mounting on the starter housing 20 and inserted into the undercut in this compressed position; after letting go, the legs spring apart into their initial position. The ends of the insert, i.e., of the wire ring 72, delimit the slot 71 formed between the ends. The slot 71 facilitates mounting. In this way, a form-fit fixation of the guide element 37 is achieved in a simple way. The form-fit fixation is realized advantageously in this context in the region of the second narrow side. Another fixation of the guide element 37 on the starter housing 20 can however be advantageous also.

As shown in FIGS. 27 and 28, the first deflection roller 40 on its circumference advantageously has a circumferential recess 70 in which the starter rope 34 is guided. The second deflection roller 41 and the third deflection roller 42 are advantageously embodied likewise.

FIGS. 29 to 36 show an embodiment of a backpack blower device 101 whose configuration substantially corresponds to that of blower device 1 (FIG. 1). In all Figures, same reference characters identify components that correspond with each other. Components that are not described in connection with blower device 101 are advantageously embodied in the same way as in blower device 1.

Figure 29:
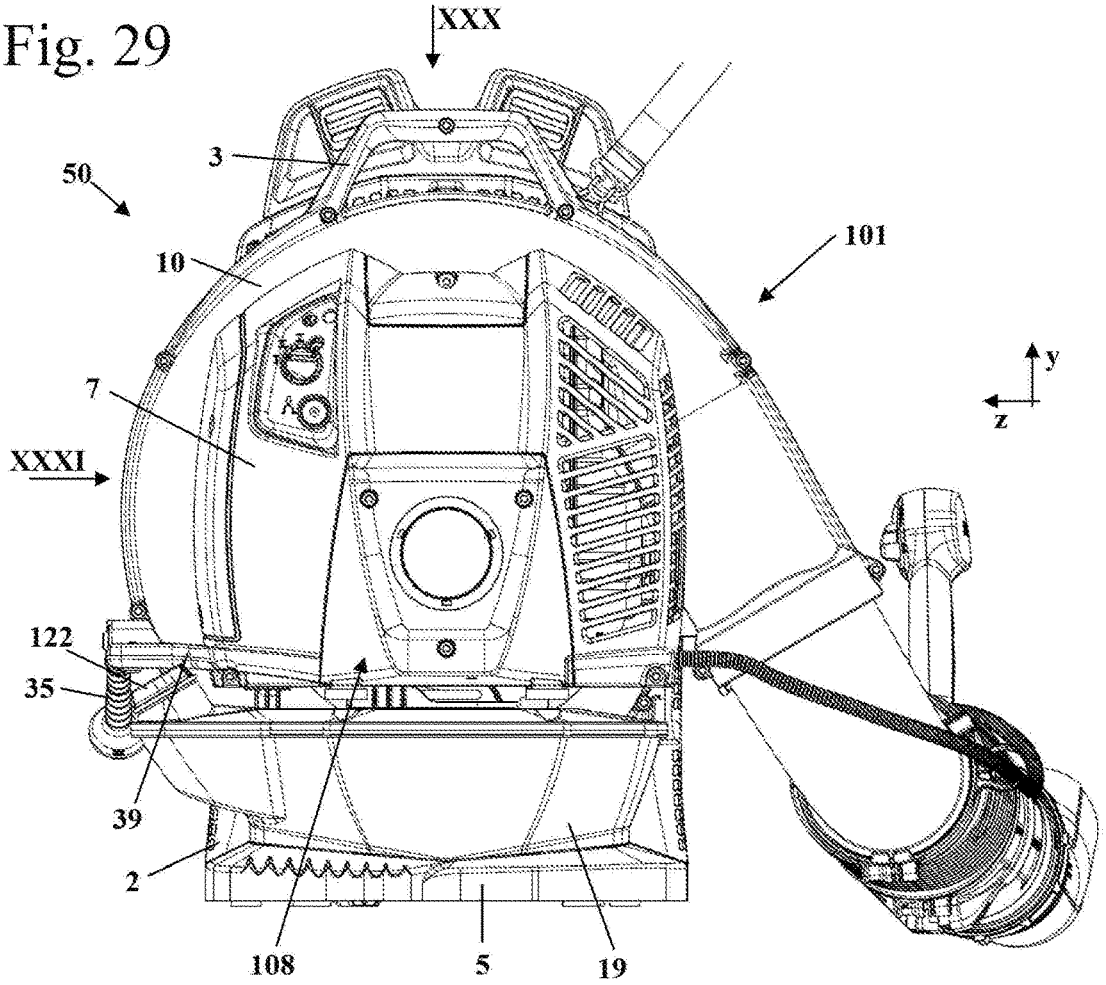
FIG. 29 is a side view of a further embodiment of a blower device.
Figure 30:
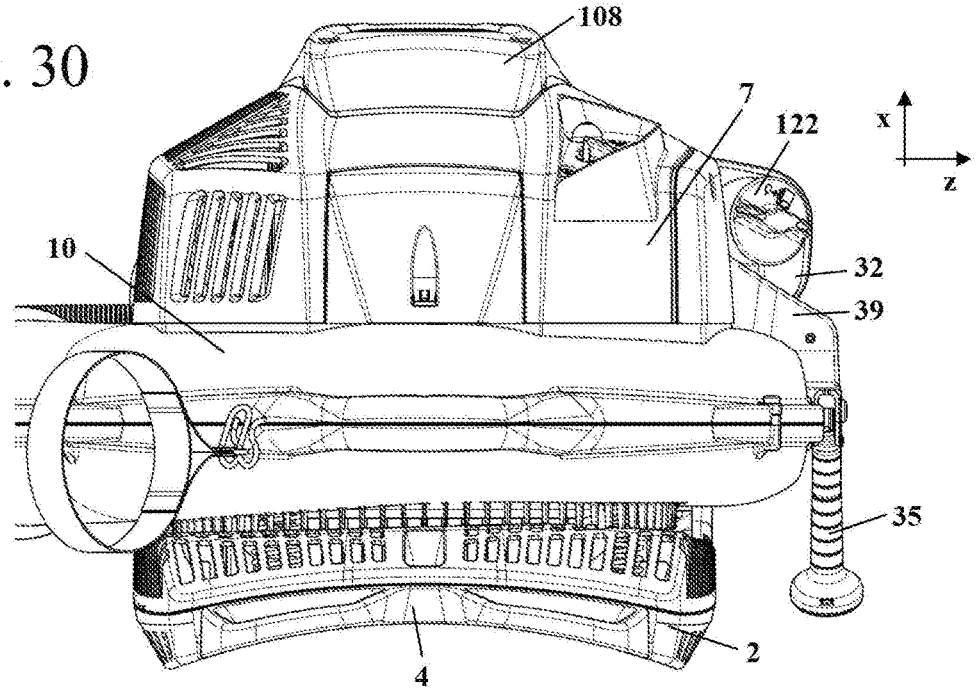
FIG. 30 is a plan view in the direction of arrow XXX of FIG. 29.

On the blower device 101, the carrying handle 3 is arranged on the blower spiral 10. As illustrated in FIG. 29, the blower device 101 has a motor housing 7 on which a starter device 108 is arranged. The starter device 108 comprises an arm 39. In the rest position 50, the fuel tank 19 of the blower device 101 is arranged below the motor housing 7. The fuel tank 19 has a region 32, illustrated in FIG. 30, which is projecting laterally past the backpack carrier 2 and is not covered in upward direction. In the region 32, a tank socket with a tank cover 122 is arranged. In the view looking on the x-z plane as illustrated in FIG. 30, i.e., in the viewing direction onto the bottom plate 5 (FIG. 29), the tank cover 122 is positioned laterally outside of the backpack carrier 2. The arm 39 extends in a plan view of the blower device 101 between the tank socket and the blower spiral 10. The starter device 108 projects laterally, i.e., in the direction of the axis z, and in the height direction, i.e., in the direction of the axis y, past the tank cover 122 so that the tank cover 122, in the viewing direction of FIG. 29 onto the y-z plane, does not form the outer boundary of the blower device 101. The tank cover 122 is arranged in a protected position in the region which is located behind the arm 39 and behind the starter handle 35 in the direction x. In this way, the tank cover 122 is shielded by the arm 39 and by the starter handle 35 from branches or the like so that damage to the tank cover 122 is prevented. At the same time, the tank cover 122 is easily accessible from above. As shown in FIG. 29, the arm 39 extends approximately parallel to the top side of the fuel tank 19 and at a spacing from the top side of the fuel tank 19. The arm 39 extends at a minimal spacing relative to the fuel tank 19 so that the section of the starter rope between the second deflection roller 41 and the third deflection roller 42 is extending also at a minimal spacing relative to the fuel tank 19.

FIGS. 29 to 32 show the starter handle 35 in a first start position 143 in which the starter handle 35 is in the first end position. When the starter device 108 is not actuated, the starter handle 35 is in the first start position 143. In the first start position 143, the starter handle 35 is slanted with its free end downwardly and forwardly relative to the support surface 51 in the rest position 50 (FIG. 31). The forward direction refers to a direction perpendicular to the back plate 4 away from the motor housing 7. The rearward direction refers to a direction perpendicular to the back plate 4 toward the motor housing 7. The downward direction refers to a direction perpendicular to the bottom plate 5 away from the motor housing 7 and the upward direction to a direction perpendicular to the bottom plate 5 toward the motor housing 7. Directions parallel to the plane of the back plate 4 and to the plane of the bottom plate 5 are lateral directions. When the backpack carrier 2 is carried by an operator on the shoulders, the directions are oriented in upright position of the operator to the front, to the rear, upward, downward, and laterally relative to the operator.

The longitudinal center axis 64 of the starter rope 34 in the rope outlet opening 36, which corresponds to the longitudinal center axis of the starter handle 35, is positioned in the first starter position 143 relative to the support surface 51 at an angle ε that amounts to less than 45°. The longitudinal center axis 64 and the support surface 51 however do not extend parallel to each other. The angle ε amounts advantageously to 25° to 40°, in particular approximately 30°. As also shown in FIG. 31, the starter handle 35 is arranged laterally in the region of the blower spiral 10 and the backpack carrier 2 and does not project past the backpack carrier 2 in the direction of the operator.

FIGS. 31 and 32 show the fixation of the arm 39 on the blower spiral 10. As shown in FIG. 31, the screw connection sleeve 63 of the arm 39 is contacting the blower spiral 10 and is secured thereat. As shown in FIG. 32, the appendage 80 of the arm 39 is inserted into a receptacle 81 of the blower spiral 10. In this way, the arm 39 is secured adjacent to the first deflection roller 40 in the direction y and in the direction z with form fit relative to the blower spiral 10.

Figure 33:
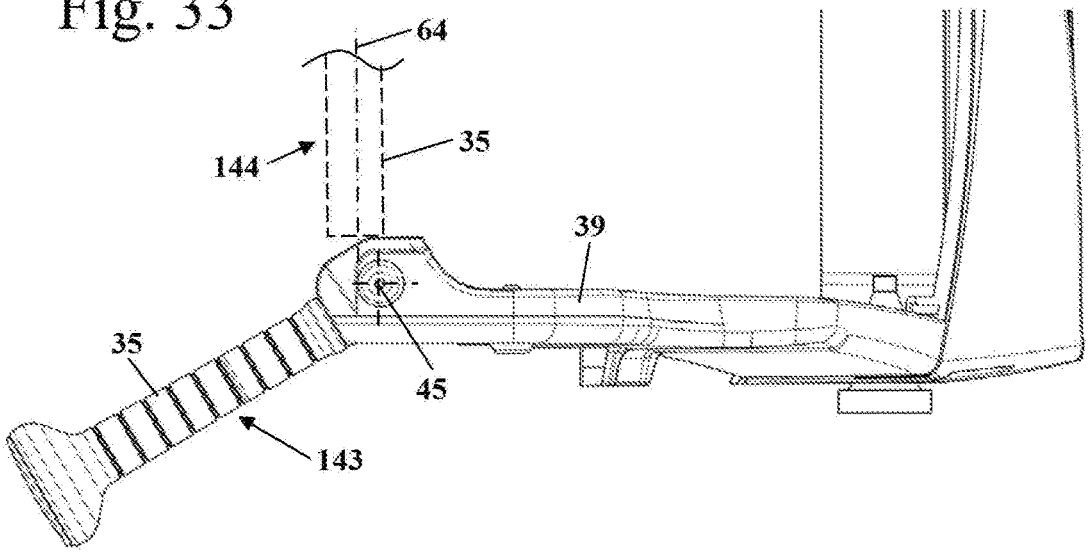
FIG. 33 is a side view of the starter device of the blower device of FIG. 29.
Figure 34:
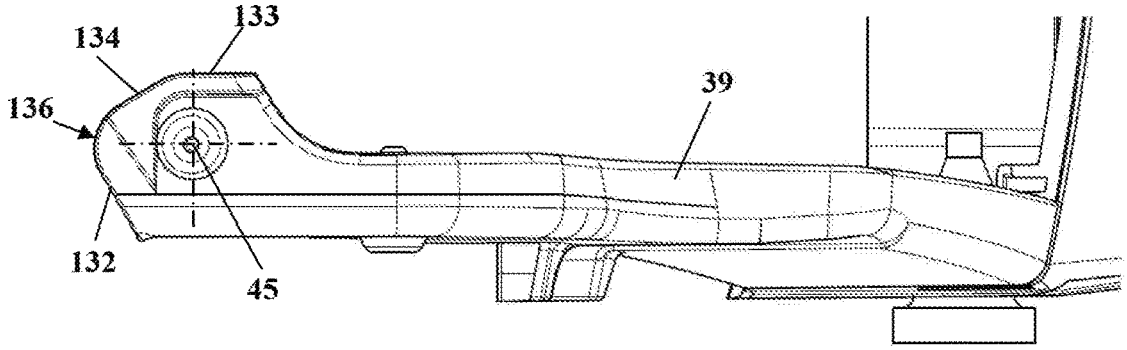
FIG. 34 is a side view according to FIG. 33 without the starter handle.

FIG. 33 shows schematically a second start position 144. In the second start position 144, the starter handle 35 projects upwardly, in particular vertically upwardly. The longitudinal center axis 64 is positioned in the second start position relative to the support surface 51 (FIG. 31) at an angle of advantageously 90°. The longitudinal center axis in the second start position 144 is slanted at an angle of less than 15°, in particular less than 10°, relative to the vertical.

The rope guide comprises a rope outlet opening 136 illustrated in FIG. 32 where a guide part 137 is arranged. The guide part 137 delimits the rope outlet opening 136. The configuration and fixation of the guide part 137 corresponds, with the exception of the shape of the guide part 137, to the configuration of the guide element 37. The guide part 137 comprises the legs 73 and 74. As shown in FIG. 33 in connection with FIG. 34, the rope outlet opening 136 comprises a first section 132 where the starter handle 35 is resting in the first start position 143. The first start position 143 corresponds in this context to a first end position of the starter handle 35. The rope outlet opening 136 comprises also a second section 133 where the starter handle 35 is resting in the second start position 144. Between the sections 132 and 133. a third section 134 is extending which comprises a flat area in the embodiment. However, it can also be provided that the third section 134 is extending completely in a curved shape. In this embodiment, the first section 132 and the second section 133 of the rope outlet opening 136 comprise different spacings to the axis 45 of the deflection roller 40.

Figure 35:
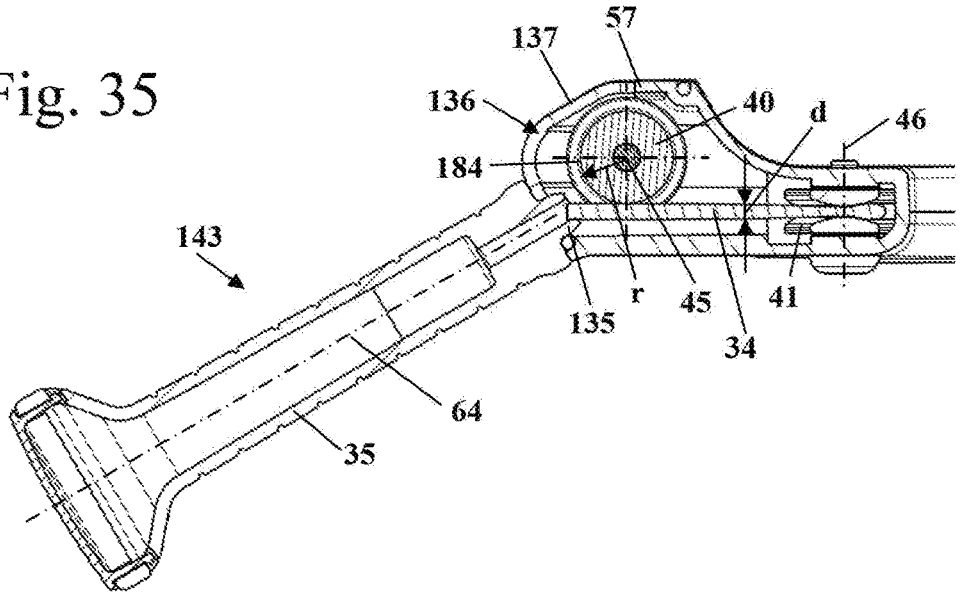
FIG. 35 is a section illustration of the starter device in the region of the first and the second deflection rollers with starter handle.
Figure 36:
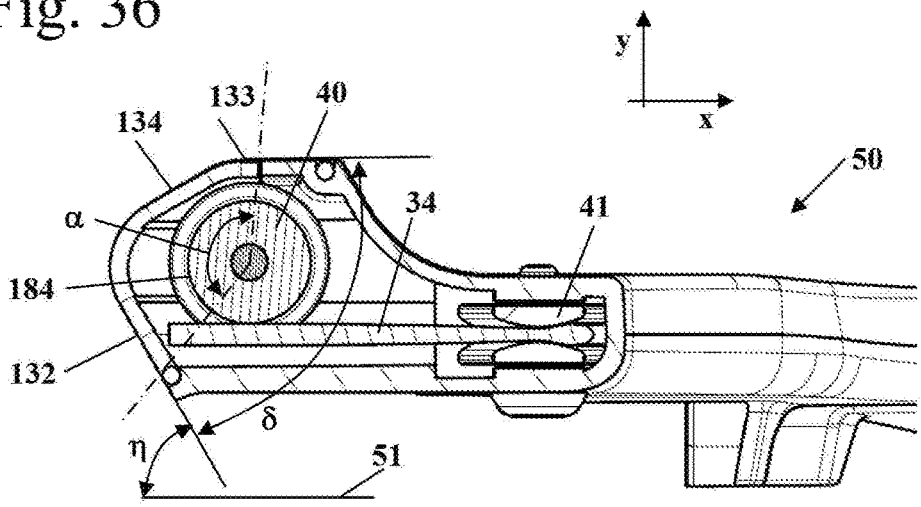
FIG. 36 is a detail section view according to FIG. 35 without the starter handle.

As illustrated in FIG. 35, the starter handle 35 comprises a pin 135 which is projecting into the rope outlet opening 136 and which secures the starter handle 35 between the two legs 73 and 74 of the wire ring 72 (FIG. 32). The deflection roller 40 does not project past the rope outlet opening 136. In FIG. 35, the housing-fixed part 57 can be seen also. The starter rope 34 is illustrated in FIGS. 35 and 36 in a shortened representation and not extended into the starter handle 35. The longitudinal center axis 64 of the starter rope 34 in the rope outlet opening 136 and at the bottom side of the starter handle 35 is illustrated in FIG. 35 with dash-dotted line. As also shown in FIG. 35, the deflection roller 40 comprises a circumferential section 184. The circumferential section 184 is the circumferential section about which the rope outlet opening 136 is extending. The deflection roller 40 has the radius r in the circumferential section 184; the radius r is larger than the length of the diameter d of the starter rope 34. Advantageously, the radius r amounts to at least twice the length of the diameter d. Preferably, the radius r amounts to at least 8 mm, in particular at least 13 mm.

As shown in FIG. 36, the sections 132 and 133 are positioned at an angle δ that amounts to less than 90°. Advantageously, the angle δ amounts to less than 70°, in particular approximately 60°. The angle δ is measured between radials relative to the axis 45 which are extending each to an end of the rope outlet opening 36 in the circumferential direction. The first section 132 extends at a slant to the vertical, i.e., at a slant to the axis y. In the rest position 50, the first section 132 is positioned relative to the support surface 51 at an angle n that amounts to more than 45°. The second section 133 extends in the embodiment parallel to the support surface 51.

As shown in the Figures, the starter housing 20 is embodied to be completely separate from the motor housing 7. Since the starter devices 8 and 108 are designed as modules whose components are all directly or indirectly connected to the starter housing 20, the starter device 8 or 108 can be mounted in a simple way as a modular assembly on an existing motor housing 7. Also, the starter device 8 or 108 can be retrofitted on existing power tools in this way. When the starter device 8 or 108 is damaged, it can therefore be easily exchanged as a whole modular unit.

Figure 37:
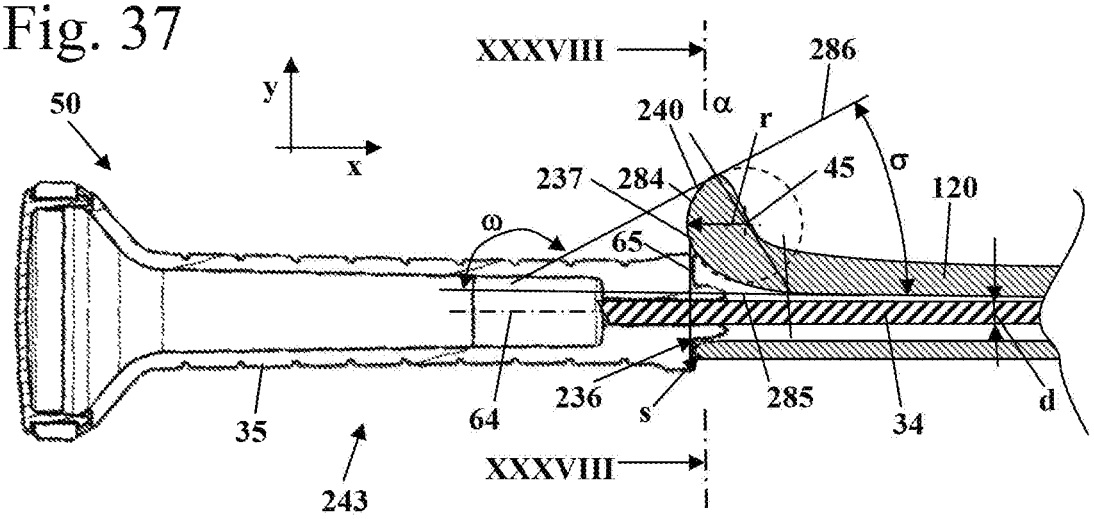
FIG. 37 is a schematic detail section view of a further embodiment of a rope guide in a first start position of the starter handle.
Figure 38:
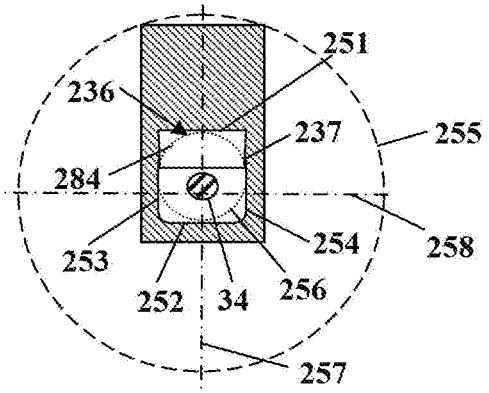
FIG. 38 is a schematic section view along the section line XXXVIII-XXXVIII of FIG. 37.
Figure 39:
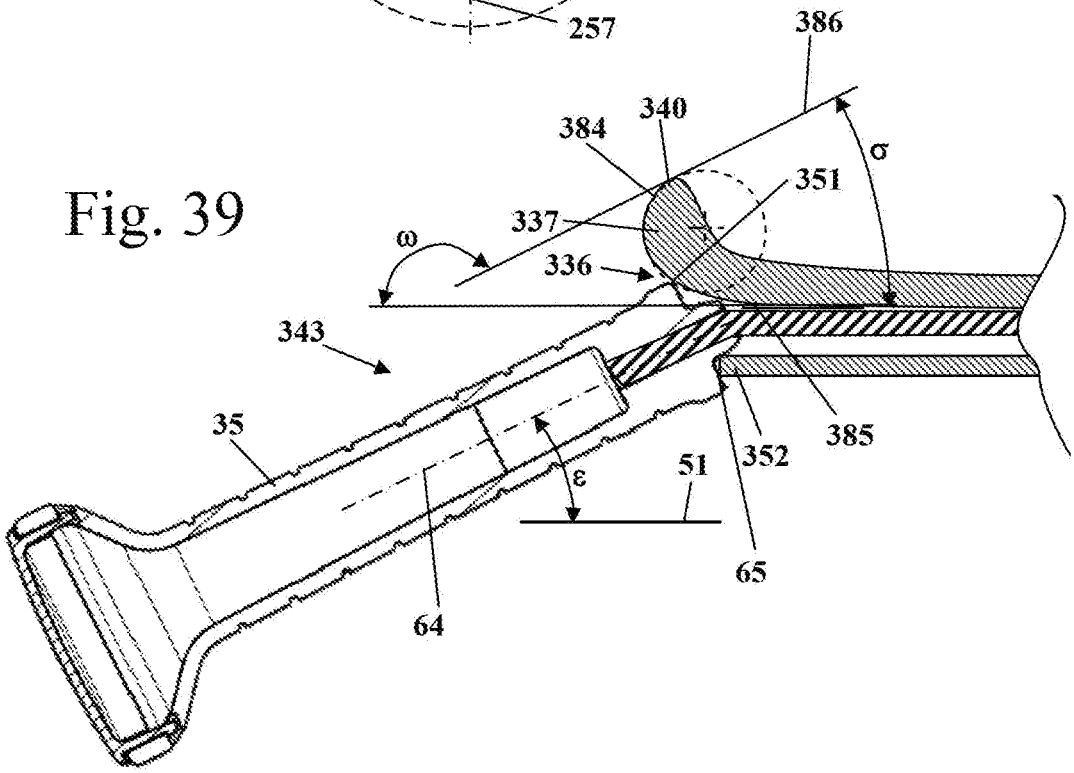
FIG. 39 is a schematic detail section view of a further embodiment in a first start position of the starter handle.

FIGS. 37 to 39 show an embodiment of a rope outlet opening 236 of a rope guide for a backpack blower device 1, 101. The rope guide is embodied in accordance with the rope guide 38 of the preceding embodiments. The rope guide comprises a starter housing 120 of which in FIG. 37 only the region adjacent to the starter handle 35 is illustrated. FIG. 37 shows the arrangement in a first start position 243 of the starter handle 35 in the rest position 50 of the blower device. In the first start position 243, the starter handle 35 in the embodiment is approximately horizontally oriented in the rest position 50. On the starter housing 120 a rope outlet opening 236 is formed which is delimited by a guide element 237. When the starter device is not actuated, the starter handle 35 is resting in the first start position 243 on the guide element 237, as illustrated in FIG. 37.

As shown in FIG. 37, the rope outlet opening 236 is extending along a circumferential section 284 of a deflection section 240 of the rope guide. The deflection section 240 forms a deflection element for the starter rope 34. The deflection section 240 is convexly curved and extends at a radius r about an axis 45. In the embodiment, the radius r is constant. However, it can also be provided that the radius r across the length of the deflection section 240 is not constant. As shown in FIG. 37, the deflection section 240 projects into the rope outlet opening 236. The circumferential section 284 extends about a wrap angle ω that amounts to at least 90°. The wrap angle ω is the angle across which the starter rope 34 can contact maximally the deflection section 240. In this context, the deflection section 240 is considered the region whose radius r corresponds to at least the length of the diameter d of the starter rope 34. Regions with a smaller radius are not part of the deflection section 240. The deflection section 240 comprises a first tangent 285 and a second tangent 286. The first tangent 285 is arranged at the beginning of the deflection section 240, i.e., in the region where the starter rope 34 will contact first when the starter handle 35 is adjusted from the first start position 243 into a second start position, not illustrated. The second tangent 286 is a tangent to the deflection section 240 at the end of the deflection section 240. The second tangent 286 corresponds approximately to the orientation of the starter rope 34 at the bottom side 65 of the starter handle 35 in the position in which the starter rope 34 rests about the entire deflection section 240 against the deflection section 240 and wraps around the deflection section 240 about the wrap angle ω. The wrap angle ω is measured between a perpendicular to the first tangent 285 at the beginning of the deflection section 240 and a perpendicular to the second tangent 286 at the end of the deflection section 240.

In the embodiment, the deflection section 240 and the rope outlet opening 236 are embodied at a one-piece component. However, it can also be provided to embody the deflection section 240 and the rope outlet opening 236 by separate components that are connected to each other. It can also be advantageous to provide at least two components which each form a section of the deflection section 240 and a section of the rope outlet opening 236. In particular, a configuration of two components that are connected to each other at a separation plane which extends in longitudinal direction of the starter rope can be advantageous. Such a separation plane is indicated in FIG. 38 schematically by means of a dash-dotted line 257. An alternative extension of such a separation plane is schematically indicated in FIG. 38 by dash-dotted line 258. In the embodiment, the deflection section 240 and the rope outlet opening 236 are integrally formed immediately on the starter housing 120. However, it can also be provided to configure the rope outlet opening and/or deflection section 240 at least partially separate from the starter housing 120, in particular as one piece or as multiple parts.

The tangents 285 and 286 are positioned at an angle σ relative to each other at a side which is facing away from the starter handle 35 in the first start position 243; this angle σ amounts to less than 90°, in particular less than 80°, advantageously less than 70°, preferably less than 60°. The angle σ is measured between the tangents 285 and 286 at the side facing away from the starter handle 35. The angle σ is measured in the region between the tangents 285 and 286 in which also the deflection section 240 is arranged. The angle σ and the warp angle ω together amount to 180°.

As is schematically shown in FIG. 38, the guide element 237 extends straight on the bottom side 252 which is facing downwardly in the rest position 50. On the topside 251 which is facing upwardly in the rest position 50, the guide element 237 is curved outwardly in a bell-mouth shape. On the vertically extending transverse sides 253 and 254, the guide element 237 is also extending straight, as illustrated in FIG. 38. The guide element 237 and the starter housing 120 in the embodiment are formed together as one piece. A configuration comprising a separate part or an insert that delimits the rope outlet opening 236 at least partially can however also be advantageous. It can also be provided that the guide element 237 is also curved outwardly at the bottom side 252 facing downwardly in the rest position 50. Also, a curvature in outward direction at the transverse sides 253 and 254 can be advantageous. In a particularly preferred embodiment, the guide element is designed to be of rotational symmetry and widens across its entire circumference in a bell-mouth shape. This is indicated schematically in FIG. 38 by dashed line 255. In this way, starting of an internal combustion engine by pulling on the starter cable 34 in lateral direction, i.e., in direction z, is possible. The rope outlet opening 236 is illustrated in a rectangular shape in FIG. 38. Another cross sections of the rope outlet opening 236 may however be advantageous also, in particular an oval or circular cross section. In FIG. 38, a circular cross section of the rope outlet opening 236 is illustrated schematically by means of dotted line 256.

It can be provided that at the rope outlet opening 236, outside of the guide element 237, a radius s is provided also. This radius s is illustrated in FIG. 37 in an exemplary fashion by means of a dashed line. The radius s outside of the guide element 37 is significantly smaller than the radius r. The radius s is preferably smaller than the diameter d of the starter rope 34, in particular smaller than 0.5 times the diameter d of the starter rope 34.

FIG. 39 shows an embodiment of a rope guide with a rope outlet opening 336. A guide element 337 is arranged on the rope outlet opening 336. The starter handle 35 is in a first start position 343 in which the starter handle 35 is slanted downwardly. The longitudinal center axis 64 of the starter rope 35 on the bottom side 65 of the starter handle 35 is positioned at an angle ε relative to the support surface 51 in the rest position 50. The angle ε can be measured as described in connection with FIG. 31. The guide element 337 comprises a deflection section 340 which corresponds approximately to the deflection section 240. The deflection section 340 projects in this context into the rope outlet opening 336. The deflection section 340 comprises a circumferential section 384 which is extending about a wrap angle ω that corresponds to the wrap angle ω illustrated in FIG. 37 and which amounts to more than 90°. The tangents 385 and 386 which corresponds to the tangents 285 and 286 are positioned at an angle σ relative to each other on the side which is opposite the starter handle 35 in the first start position 343; this angle σ amounts to less than 90°, in particular less than 80°, advantageously less than 70°, preferably less than 60°.

The circumferential section 384 is the circumferential section of the deflection section 340 across which the rope outlet opening 336 is extending. The circumferential section 384 is thus the circumferential section against which the starter rope 34 can rest. In this context, the starter rope 34 can be contacting the circumferential section 284 about the wrap angle ω. The radius r is not illustrated in FIG. 39 but is measured in the way described in connection with FIG. 37. The rope outlet opening 336 comprises a bottom side 352 that corresponds with respect to its configuration to the bottom side 252 of the rope outlet opening 236. The bottom side 352 of the rope outlet opening 336 is however displaced away from the starter handle 35 in comparison to the embodiment of FIG. 37. In this way, a slanted position of the starter handle 35 in downward direction results. Advantageously, the transverse sides of the rope outlet opening 336, not illustrated in FIG. 39, are positioned at a slant to the vertical and connect the bottom side 352 in a straight line with a topside 351. The configuration of the rope guide illustrated in FIG. 39 is advantageously corresponding to the configuration of the rope guide illustrated in FIG. 37, with the exception of the position of the bottom side 352 of the rope outlet opening 336.

Figure 40:
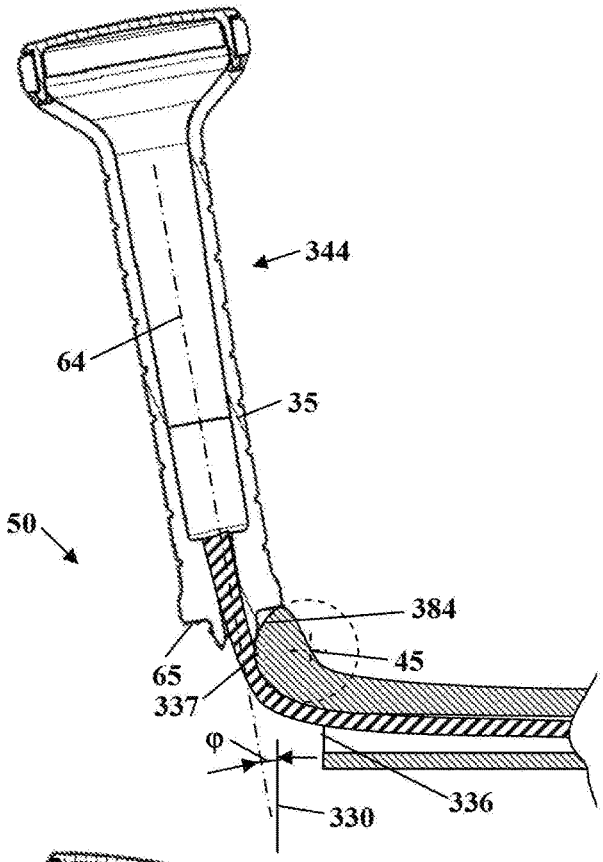
FIG. 40 is a schematic detail section view of the embodiment of FIG. 39 in a second start position of the starter handle.

FIG. 40 shows the starter handle 35 in a second start position 344. In the second start position 344, the starter handle 35 is oriented slightly inclined in upward direction. In the second start position 344, the longitudinal center axis 64 of the starter rope 34 is positioned at the bottom side 65 of the starter handle 35 relative to a vertical 330 at an angle φ that amounts to less than 15°, in particular less than 10°. Accordingly, the starter handle 35 can be pulled in upward direction by the operator. The starter handle 35 is positioned with its bottom side 65 at the top side of the guide element 337 in the rest position 50.

Figure 41:
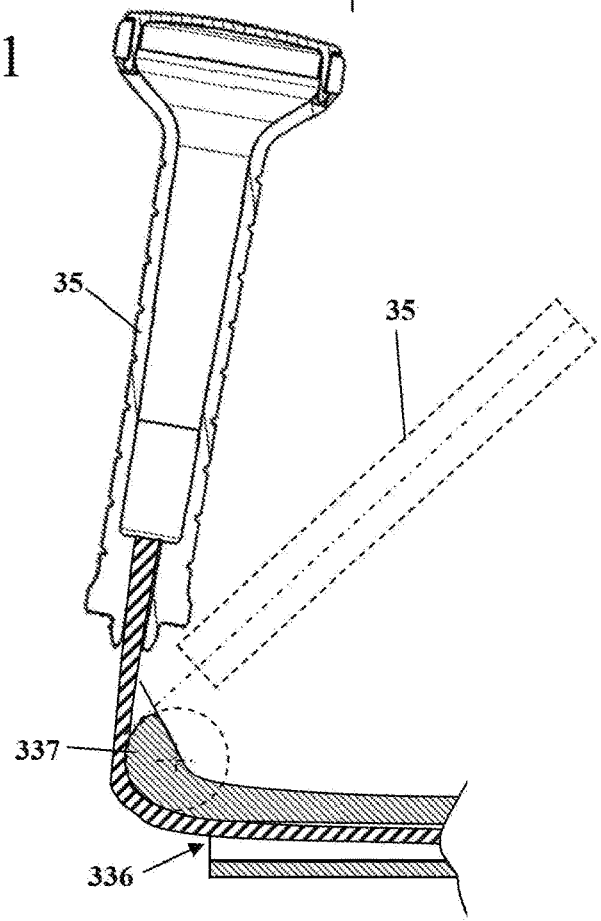
FIG. 41 is a schematic detail section view of the embodiment of FIG. 40 with the starter handle in a partially pulled-out position.

FIG. 41 shows the starter handle 35 during the starting process. As shown in FIG. 41, the starter handle 35 can be pulled upwardly and at a slant to the rear so that the starter rope 34 is resting about most of or about the entire wrap angle ω against the guide element 337. In this way, the operator can start a backpack power tool provided with a starter device according to FIG. 41 also by pulling at the starter rope 34 in upward direction and away from the back plate 4 (FIG. 1) in the rest position 50. This orientation of the starter handle 35 is illustrated in FIG. 41 with dashed lines. Since the starter rope 34 is pulled about the radius r across the guide element 337, damage to the starter rope 34 is prevented.

In order to reduce friction and/or wear on the guide element 237, 337, the guide element 237, 337 can be at least partially formed of material that is different from the material of the starter housing 120, in particular of metal. Preferably, the deflection section 240, 340 is at least partially made of metal, in particular is formed by a metallic insert. As an alternative, the deflection section 240, 340 can also be embodied of ceramic material or plastic material, in particular fiber-reinforced plastic material. The deflection section 240, 340 can also be comprised of other wear-resistant materials.

The circumferential section 284, 384, across which the rope outlet opening 236, 336 is extending, is measured between tangents 285, 286 or 385, 386 to the starter rope 34 in the first start position 243, 343 and the second start position 344. In the first start position 243, 343, the starter handle is arranged in a first end position at the rope outlet opening 236, 336, and, in the second start position 344, the starter handle is arranged in a second end position at the rope outlet opening 236, 336. The circumferential section 284, 384 is thus the section across which the starter rope 35 has maximum contact when pulling on the starter handle 35. In all embodiments, the minimal radius r of the circumferential section 84, 184, 284, 384 is greater than the length of the diameter d of the starter rope 34, in particular greater than twice the length of the diameter d of the starter rope 34. The deflection sections 240, 340 may comprise a groove on the circumference for lateral guiding of the starter rope 34, as is shown in connection with the deflection roller 40. It can be provided that the deflection sections 240, 340 project, as shown, into the rope outlet openings 236, 336. However, it can be advantageous also that the deflection sections 240, 340 are arranged outside of the rope outlet openings 336, 336 and in particular adjoin the rope outlet openings 236, 336. Also, a minimal spacing between the rope outlet opening 236, 336 and the deflection section 240, 340 can be advantageous. The spacing corresponds advantageously at most to 4 times the length of the minimal radius, in particular at most twice the length of the minimal radius of the deflection element.

It can be advantageous that the starter handle 35 in the first start position 43, 143, 243, 343 is arranged at least partially in the rope outlet opening 36, 136, 236, 336. It can be provided that the starter handle 35 with the exception of the thicker head is completely arranged in the rope outlet opening 36, 136, 236, 336. An arrangement of the starter handle 35 in a rope outlet opening is in particular considered advantageous for a rope outlet opening which widens in all directions, i.e., has a bell-mouth shape.

All embodiments can be combined with each other. In particular other angles than the indicated angle ranges are possible. The arrangement of the deflection rollers 41 and 42 is not limited to the embodiments; other positions and orientations of the deflection rollers 41 and 42 are possible also. In particular, a deviating orientation of the axes 46 and 47 can be advantageous. Also, a different position, orientation, or alignment of the axis 45 of the deflection roller 40 can be advantageous.

While specific embodiments of the invention have been shown and described in detail to illustrate the inventive principles, it will be understood that the invention may be embodied otherwise without departing from such principles.

What is claimed is:

1. A starter device for an internal combustion engine, the starter device comprising:

a rope pulley;

a starter rope wound onto the rope pulley;

a starter handle fastened to the starter rope;

a rope guide configured to guide the starter rope from the guide pulley to a rope outlet opening of the starter device;

a guide element disposed at the rope outlet opening and holding the starter rope in the rope outlet opening;

wherein the rope guide comprises at least one deflection element that is arranged at the rope outlet opening;

wherein the deflection element comprises two tangents which are intersecting each other at an angle of less than 90';

wherein the deflection element has a minimal radius of a length that is longer than a length of a diameter of the starter rope.

2. The starter device according to claim 1, wherein the starter handle comprises a first end position and a second end position, wherein a first one of the two tangents corresponds to a longitudinal direction of the starter rope in the first end position of the starter handle, and wherein a second one of the two tangents corresponds to the longitudinal direction of the starter rope in the second end position of the starter handle.

3. The starter device according to claim 1, wherein the angle at which the two tangents are intersecting each other is measured at a side of the deflection element facing away from the rope outlet opening, and wherein a sum of the angle at which the two tangents are intersecting each other and of a maximum deflection angle of the starter rope at the deflection element amounts to 180°.

4. The starter device according to claim 1, wherein the angle at which the two tangents are intersecting each other amounts to less than 80°.

5. The starter device according to claim 1, wherein the angle at which the two tangents are intersecting each other amounts to less than 70°.

6. The starter device according to claim 1, wherein the angle at which the two tangents are intersecting each other amounts to less than 60°.

7. The starter device according to claim 1, wherein the length of the minimal radius of the deflection element amounts to at least 8 mm.

8. The starter device according to claim 1, wherein the length of the minimal radius of the deflection element amounts to at least 13 mm.

9. The starter device according to claim 1, wherein a spacing measured between the deflection element and the rope outlet opening amounts to at most 4 times the length of the minimal radius.

10. The starter device according to claim 1, wherein the deflection element projects through the rope outlet opening into the rope guide.

11. A backpack power tool comprising:

a backpack carrying system;

an internal combustion engine arranged on the backpack carrying system;

a starter device for the internal combustion engine, wherein the starter device comprises a rope pulley; a starter rope wound onto the rope pulley; a starter handle fastened to the starter rope; a rope guide configured to guide the starter rope from the guide pulley to a rope outlet opening of the starter device; and a guide element disposed at the rope outlet opening and holding the starter rope in the rope outlet opening; wherein the rope guide comprises at least one deflection element that is arranged at the rope outlet opening, wherein the deflection element comprises two tangents which are intersecting each other at an angle of less than 90°, and wherein the deflection element has a minimal radius of a length that is longer than a length of a diameter of the starter rope;

wherein the power tool comprises a rest position in which the power tool is positioned on a flat horizontal support surface;

wherein the starter handle comprises a first start position, wherein in the first start position the starter rope in the rope outlet opening is positioned at an angle of less than 45° relative to the flat horizontal support surface in the rest position of the power tool;

wherein the starter handle has a second start position, wherein in the second start position the starter rope in the rope outlet opening is slanted relative to a vertical at an angle of less than 15° in the rest position of the power tool.

12. The power tool according to claim 11, wherein the starter handle, when the starter device is not actuated, is arranged in the first start position.

13. The power tool according to claim 11, wherein the starter device comprises a recoiling device which generates on the starter rope a force acting in a recoiling direction, wherein the guide element is configured such that the force of the recoiling device exerts a force component on the starter handle in the second start position, and wherein the force component is acting on the starter handle in a direction toward the first start position.

14. The power tool according to claim 11, wherein the starter device comprises a starter housing in which the rope guide is arranged, wherein the power tool further comprises a motor housing in which the internal combustion engine is arranged, wherein the starter housing and the motor housing of the power tool are embodied separate from each other.

* * * * *